US006211763B1

(12) United States Patent
Morita

(10) Patent No.: US 6,211,763 B1
(45) **Date of Patent: *Apr. 3, 2001**

(54) IGNITION COIL APPARATUS FOR AN INTERNAL COMBUSTION ENGINE AND PRODUCTION METHOD THEREOF

(75) Inventor: Shingo Morita, Hyogo-ken (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/867,807

(22) Filed: Jun. 3, 1997

Related U.S. Application Data

(63) Continuation of application No. 08/528,531, filed on Sep. 14, 1995, now abandoned.

(30) Foreign Application Priority Data

Oct. 7, 1994 (JP) ..... 6-244357

(51) Int. Cl.[7] ..... H01F 21/00

(52) U.S. Cl. ..... 336/110; 336/178; 336/96

(58) Field of Search ..... 336/178, 110, 336/212, 96

(56) References Cited

U.S. PATENT DOCUMENTS

| | | | | |
|---|---|---|---|---|
| 4,866,409 | * | 9/1989 | Umezaki | 336/96 |
| 4,990,881 | * | 2/1991 | Ooyaba | 336/110 |
| 5,128,645 | * | 7/1992 | Suda | 336/178 |
| 5,128,646 | * | 7/1992 | Suzuki et al. | 336/110 |
| 5,349,320 | * | 9/1994 | Suzuki et al. | 336/96 |

FOREIGN PATENT DOCUMENTS

| | | |
|---|---|---|
| 37 41 032 C2 | 11/1990 | (DE) . |
| 6466913 | 3/1989 | (JP) . |
| 6466914 | 3/1989 | (JP) . |
| 1-87517 | 6/1989 | (JP) . |

OTHER PUBLICATIONS

Abstracts of Japan, 4–102307 (A) Jul. 23, 1993 (with copy of reference in Japanese).

* cited by examiner

*Primary Examiner*—Michael L. Gellner
*Assistant Examiner*—Tuyen T. Nguyen
(74) *Attorney, Agent, or Firm*—Sughrue, Mion, Zinn, Macpeak & Seas, PLLC

(57) ABSTRACT

To drastically increase output energy generated by means of an electromagnetic function in a small-sized ignition coil apparatus having a plurality of magnetic circuits arranged around and coaxially with a hole for passing therethrough a shaft.

The primary coil 4 and the secondary coil 5 are stored in the container 3 formed in the synthetic resin case 1 and arranged around and coaxially with the hole 2 for passing therethrough the shaft rotating in synchronization with the rotation of the internal combustion engine, cores 6 for forming a plurality of magnetic circuits for magnetically coupling the primary coil 4 and the secondary coil 5 by supplying electricity to the primary coil 4 are also stored in the container, the permanent magnet 10 is arranged in at least one of the magnetic circuits formed by the plurality of cores 6 to provide the cores with a magnetic flux 12 opposite in direction to the magnetic flux 11 of the magnetic circuit, and the plurality of cores 6 cancel the magnetic flux 12 caused by the permanent magnet 10 by supplying electricity to the primary coil 4 and generate a saturated magnetic flux which is large enough to saturate the cores 6, thereby making it possible to reduce the number of permanent magnets 10 as well as the number of assembly steps.

34 Claims, 14 Drawing Sheets

IGNITION COIL APPARATUS FOR AN INTERNAL COMBUSTION ENGINE AND PRODUCTION METHOD THEREOF

This is a Continuation of application Ser. No. 08/528,531 filed Sep. 14, 1995, now abandoned.

BACKGROUND OF THE INVENTION

1. Field of the Invention

This invention relates to an ignition coil apparatus for use in a distributor for supplying a high voltage to the plug of an internal combustion engine at the time of igniting the internal combustion engine.

2. Description of the Prior Art

FIG. 12 shows an example of a prior art ignition coil for an internal combustion engine in which a permanent magnet is arranged in the closed magnetic path of a core. In FIG. 12, reference numeral 30 represents a case, 31 a container formed inside the case 30, 32 a primary coil stored in the container 31, 32*a* a bobbin to which the primary coil 32 is wound, 32*b* a hole formed at the center of the bobbin 32*a*, 33 a secondary coil stored in the container 31 and arranged around and concentrically with the primary coil 32, 33*a* a bobbin to which the secondary coil 33 is wound, and 34 a core for forming a single magnetic circuit for magnetically coupling the primary coil 32 and the secondary coil 33. This core 34 has two U-shaped cut cores 34*a* and 34*b* which are arranged in such a manner that their end surfaces face each other to form a ring-shaped core 34. The inner foot of the cut core 34*a* is inserted into the hole 32*b* of the bobbin 32*a* of the primary coil 32 from one side of the hole 32*b* whereas the inner foot of the cut core 34*b* is inserted into the hole 32*b* of the bobbin 32*a* from the other side. The end surfaces of these two inner feet are placed in contact with the permanent magnet 35 arranged therebetween. The outer foot of the cut core 34*a* and the outer foot of the cut core 34*b* are arranged along the outer wall of the case 30 to enclose outer portions of the primary coil 32 and the secondary coil 33 and the end surfaces of these two outer feet are in contact with each other. The above-mentioned permanent magnet 35 provides the core 34 with a magnetic flux 37 indicated by a dotted line which is opposite in direction to a magnetic flux 36 indicated by a one-dot chained line, generated in the core 34 while electricity is supplied to the primary coil 32. Numeral 38 denotes an insulating resin which is poured into the container 31 and solidified after the core 34 is attached to the primary coil 32 and the secondary coil 33 stored in the container 31.

Consequently, in the ignition coil apparatus shown in this FIG. 12, since the permanent magnet 35 provides the core 34 with the magnetic flux 37 opposite in direction to the magnetic flux 36 generated in the core 34 while electricity is supplied to the primary coil 32, the magnetic flux 36 generated in the core 34 by applying electricity to the primary coil 32 cancels the magnetic flux 37 generated by the permanent magnet 35 and is grown into a saturated magnetic flux which is large enough to saturate the core 34. Therefore, compared with the case where there is no permanent magnet 35, magnetic force stored in the core 34 increases and electric power output from the secondary coil 33 rises.

FIG. 13 is a side view of a distributor in which an ignition coil apparatus is arranged coaxially with a shaft rotating in synchronization with the rotation of an internal combustion engine and FIG. 14 is a sectional view of the ignition coil apparatus of the distributor.

In FIG. 13, reference numeral 20 represents a base, 21 the shaft which rotates in synchronization with the rotation of the internal combustion engine and is rotatably mounted on the base 20, 22 an ignition coil apparatus arranged coaxially with the shaft 21, 23 an electric unit comprising electronic circuits such as a crank angle sensor, power transistor and other electronic parts, 24 a cap, 25 a connector protruding outward from the electric unit 23, and 26 a screw. The base 20, ignition coil apparatus 22, electric unit 23 and cap 24 are assembled into a single unit in such a manner that the ignition coil apparatus 22 is mounted on the base 20 to which the shaft 21 is attached, the electric unit 23 is arranged on the ignition coil apparatus 22, and the cap 24 is placed over the electric unit 23.

In FIG. 14, numeral 1 represents a cylindrical case made of a synthetic resin having a bottom portion in the ignition coil apparatus 22 of FIGS. 13, 2 a hole formed at the center of the bottom portion of the case 1 for passing the shaft therethrough, 3 a container formed in the case 1 with the wall surrounding the hole 2 and the bottom portion and the outer wall of the case 1, 4 a primary coil arranged in the container 3 around the hole 2, 5 a secondary coil arranged in the container 3 around and coaxially with the primary coil 4, and 6 cores for forming four magnetic circuits for magnetically coupling the primary coil 4 and the secondary coil 5 by supplying a primary current to the primary coil 4. These cores 6 are stored in the container 3 and arranged around the hole 2 at intervals of a right angle so that they cross-chain the primary coil 4 and the secondary coil 5. Each core 6 is composed of a pair of U-shaped cut cores 6*a* and 6*b* arranged around the hole 2 at intervals of a right angle and astride the primary coil 4 and the secondary coil 5 from above and below in the direction of the center line of the hole 2, and the end surfaces of the cut cores 6*a* and 6*b* face each other in vertical direction so that the cores 6 are each ring-shaped to cross-chain the primary coil 4 and the secondary coil 5 at intervals of a right angle. The cut core 6*a* is integrated with the case 1 by insertion at the time when the case 1 is molded, whereas the cut core 6*b* is stored in the container 3 after the primary coil 4 and the secondary coil 5 are stored in the container 3. The inner foot of the cut core 6*a* is interposed between the primary coil 4 and the wall of the hole 2 whereas the inner foot of the cut core 6*b* is inserted between the primary coil 4 and the wall of the hole 2 from above, and the end surfaces of the inner feet of the two cut cores 6*a* and 6*b* are contacted to each other in a vertical direction. The other foot of the cut core 6*a* is interposed between the secondary coil 5 and the outer wall of the case 1 whereas the other foot of the cut core 6*b* is inserted between the secondary coil 5 and the outer wall of the case 1, and the end surfaces of the other feet of the two cut cores 6*a* and 6*b* are made apart from each other in vertical direction to form a gap 7 having a predetermined distance therebetween. Numeral 8 represents a synthetic resin cover for aligning the cut core 6*b* with the cut core 6*a* in vertical direction. The extending ends of the four arms of the covers 8 extend from the inner surface of the outer wall of the case 1 and fit in position determination portions of the case 1, and a back portion of the cut core 6*b* astride the opposing feet is arranged over the cover 8. Numeral 9 denotes an insulating resin which is poured into the container 3 and solidified after the cut core 6*b* is installed over the primary coil 4 and the secondary coil 5 stored in the container through the cover 8.

Therefore, in the ignition coil apparatus shown in FIG. 14, each time a primary current flows through the primary coil 4 upon ignition of the internal combustion engine, the secondary coil 5 which is magnetically coupled to the primary coil 4 by the core 6 generates a high voltage for igniting the internal combustion engine. At this time, since the core 6 is provided with a high magnetic field by the gap 7 while electricity is supplied to the primary coil 4, efficiency of magnetism stored in the core 6 by supplying electricity to the primary coil 4 is excellent. Moreover, since the ignition coil apparatus is structured such that the base, electric unit and gap are arranged around the shaft in tiers as shown in FIG. 13 and that a plurality of cores 6 are arranged around the hole 2 at intervals of a right angle to cross-chain the primary coil 4 and the secondary coil 5 as shown in FIG. 14, its volume efficiency is higher than the ignition coil apparatus shown in FIG. 12, which is extremely effective for reducing the size of the distributor.

Although the ignition coil apparatus shown in FIG. 12 is structured such that a single core is provided with a permanent magnet to increase output energy as described above, it is arranged decentrically with the shaft of the distributor. On the other hand, the ignition coil apparatus shown in FIG. 14 is arranged coaxially with the shaft of the distributor, is excellent in efficiency of magnetism due to the provision of the four cores 6, and has a structure that contributes to a reduction in the size of the distributor, but it has no permanent magnet.

Then, it is conceivable to obtain an ignition coil apparatus having a permanent magnet for a plurality of cores 6, excellent efficiency of magnetism and increased output energy. However, just the provision of a permanent magnet for each of a plurality of cores 6 increases the number of permanent magnets, the number of parts and the number of assembly steps, and accordingly, it is hard to adopt this approach immediately. In other words, when a permanent magnet is provided for each of the plurality of cores 6, even if this approach is limited to comparatively practical structures, the following structures are conceivable and it is impossible to implement this approach immediately.

(1) Permanent magnets are arranged on all the contact surfaces of the cut cores 6;
(2) Permanent magnets are arranged on all the inner contact surfaces of the cut cores 6;
(3) Permanent magnets are arranged on all the outer contact surfaces of the cut cores 6;
(4) A permanent magnet is arranged in the existing gap 7 of each core 6;
(5) Permanent magnets are arranged at positions other than the existing gap 7 of each core 6;
(6) Permanent magnets are arranged in such a manner that they do not impair the usability of parts constituting each core 6;
(7) Emphasis is placed on workability and parts constituting each core 6 have their own shapes;
(8) Permanent magnets are arranged alternately on the inner and outer contact surfaces of the cores 6;
(9) A permanent magnet is arranged in the entire gap; and
(10) A permanent magnet is arranged in half of the gap and the other half of the gap is made an air gap 7.

SUMMARY OF THE INVENTION

This invention has been made to solve the above problem and it is therefore an object of the invention to present a concrete structure for arranging a permanent magnet in a small-sized ignition coil apparatus having a plurality of cores arranged coaxially with a shaft, and to provide an ignition coil apparatus which is excellent magnetically and in terms of productivity, has increased output energy, and can be put to practical use.

According to a first aspect of the invention claimed in claim 1, there is provided an ignition coil apparatus for an internal combustion engine wherein a primary coil and a secondary coil are stored in a container formed in a synthetic resin case and arranged around and coaxially with a hole for passing therethrough a shaft rotating in synchronization with the internal combustion engine, cores for forming a plurality of magnetic circuits for magnetically coupling the primary coil and the secondary coil by supplying electricity to the primary coil are stored in the container, and a permanent magnet is arranged in at least one of the magnetic circuits formed by the plurality of cores to provide the cores with a magnetic flux opposite in direction to a magnetic flux generated by the magnetic circuit.

According to a second aspect of the invention claimed in claim 2, there is provided an ignition coil apparatus wherein a primary coil and a secondary coil are stored in a container formed in a synthetic resin case and arranged around and coaxially with a hole for passing therethrough a shaft rotating in synchronization with the internal combustion engine, cores for forming a plurality of magnetic circuits for magnetically coupling the primary coil and the secondary coil by supplying electricity to the primary coil are stored in the container, and a permanent magnet is arranged in all of the magnetic circuits formed by the plurality of cores to provide the cores with a magnetic flux opposite in direction to a magnetic flux generated by the magnetic circuits.

According to a third aspect of the invention claimed in claim 3, there is provided an ignition coil apparatus wherein each of the plurality of the cores of the first aspect of the invention is composed of a pair of cut cores, the opposing end surfaces of the cut cores are placed in contact with each other, the other end surfaces of the cut cores are made apart from each other to form a gap having a predetermined distance therebetween, and a permanent magnet is arranged in at least one or all of the gaps.

According to a fourth aspect of the invention claimed in claim 4, there is provided an ignition coil apparatus wherein the permanent magnet of the first aspect is arranged on the inner side of the apparatus when seen from the primary coil.

According to a fifth aspect of the invention claimed in claim 5, there is provided an ignition coil apparatus wherein the permanent magnet of the first aspect is arranged on the outer side of the apparatus when seen from the primary coil.

According to a sixth aspect of the invention claimed in claim 6, there is provided an ignition coil apparatus wherein the permanent magnet is integrated with a synthetic resin molded part which constitutes the ignition coil apparatus.

According to a seventh aspect of the invention claimed in claim 7, there is provided an ignition coil apparatus wherein the permanent magnet of the first aspect is pre-fixed to the end surface of the cut core for forming a gap by means other than its own magnetic force.

According to an eight aspect of the invention claimed in claim 8, there is provided an ignition coil apparatus wherein the permanent magnet of the first aspect is prepared by magnetizing a magnetic material after the magnetic material is integrated with a component of the ignition coil apparatus or the ignition coil apparatus is assembled.

According to a ninth aspect of the invention claimed in claim 9, there is provided an ignition coil apparatus wherein a magnetic material for the permanent magnet of the first aspect is a rare earth metal.

According to a tenth aspect of the invention claimed in claim 10, there is provided a method for producing an ignition coil apparatus for an internal combustion engine which comprises the steps of:

preparing a synthetic resin case having a hole for passing therethrough a shaft rotating in synchronization with the rotation of the internal combustion engine, a container formed around the hole and cut cores integrated therewith, a primary coil, a secondary coil, a permanent magnet and the other cut cores;

storing the primary coil and the secondary coil in the container coaxially with each other to cross-chain the cut cores;

arranging and adsorbing the permanent magnet to the end surface of the other cut core for forming a gap;

storing the other cut cores including the permanent magnet so as to cross-chain the primary coil and the secondary coil;

causing the other cut cores including the permanent magnet to enclose the primary coil and the secondary coil so as to form a plurality of cores; and pouring an insulating resin into spaces formed by storing the primary coil, the secondary coil and the plurality of cores in the container and solidifying the resin to fix the primary coil, the secondary coil and the plurality of cores to the case.

In the ignition coil apparatus for an internal combustion engine according to the first aspect of the invention, a plurality of cores stored in the container formed in the synthetic resin case and arranged around and coaxially with the hole for passing therethrough the shaft rotating in synchronization with the rotation of the internal combustion engine cancel a magnetic flux caused by the permanent magnet by supplying electricity to the primary coil and generate a saturated magnetic flux which is large enough to saturate the cores, and the number of required permanent magnets as well as the number of parts and the number of assembly steps can be reduced.

In the ignition coil apparatus for an internal combustion engine according to the second aspect of the invention, the cores cancel a magnetic flux caused by the permanent magnet by supplying electricity to the primary coil and generate the maximum saturated magnetic flux which is large enough to saturate the cores.

In the ignition coil apparatus for an internal combustion engine according to the third aspect of the invention, since the permanent magnet is arranged in the gap formed between the opposing end surfaces of the cut cores, an electromagnetically excellent, small-sized ignition coil apparatus can be obtained without impairing the usability of existing components.

In the ignition coil apparatus for an internal combustion engine according to the fourth aspect of the invention, since the permanent coil is arranged on the inner side of the apparatus when seen from the primary coil, the single permanent magnet is ring shaped so that it can be arranged in the magnetic circuits of the plurality of cores.

In the ignition coil apparatus for an internal combustion engine according to the fifth aspect of the invention, since the permanent magnet is arranged on the outer side of the apparatus when seen from the primary coil, existing components can be used.

In the ignition coil apparatus for an internal combustion engine according to the sixth aspect of the invention, since the permanent magnet is integrated with a synthetic resin molded part of the ignition coil, handling and assembly ease of the permanent magnet can be improved.

In the ignition coil apparatus for an internal combustion engine according to the seventh aspect of the invention, since the permanent magnet is pre-fixed to the cut core by means other than its own magnetic force, it is possible to reduce the number of assembly steps, improve handling ease of the permanent magnet and prevent misinstallation of the permanent magnet during the assembly of the ignition coil apparatus.

In the ignition coil apparatus for an internal combustion engine according to the eighth aspect of the invention, since the magnetic material is magnetized after it is installed, it is possible to improve handling ease of the permanent magnet and prevent misinstallation of the permanent magnet during the assembly of the ignition coil apparatus.

In the ignition coil apparatus for an internal combustion engine according to the ninth aspect of the invention, since the magnetic material of the permanent magnet is a rare earth metal, it is possible to suppress demagnetization of the permanent magnet and ensure reliability thereof.

In the ignition coil apparatus for an internal combustion engine according to the tenth aspect of the invention, it is possible to obtain an electromagnetically excellent ignition coil apparatus with ease by adding the simple step of adsorbing the permanent magnet to the end surface of the cut core to the steps of the conventional production method.

The above and other objects, features and advantages of the invention will become more apparent from the following description when taken in conjunction with the accompanying drawings.

DESCRIPTION OF THE PREFERRED EMBODIMENT

Preferred embodiments of the present invention are described below with reference to FIGS. 1 to 11 wherein the same or corresponding parts as those of the prior art are given the same reference codes and their descriptions are omitted.

Embodiment 1

Figure 1A:
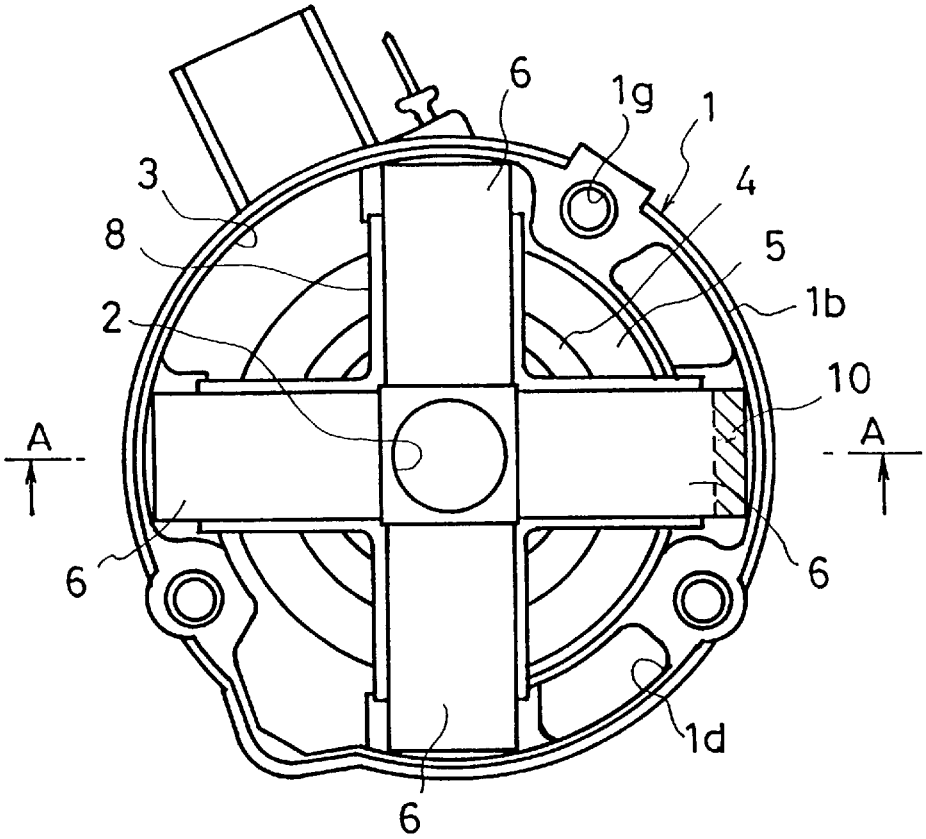
FIG. 1 is a diagram of an ignition coil apparatus according to Embodiment 1.
Figure 1B:
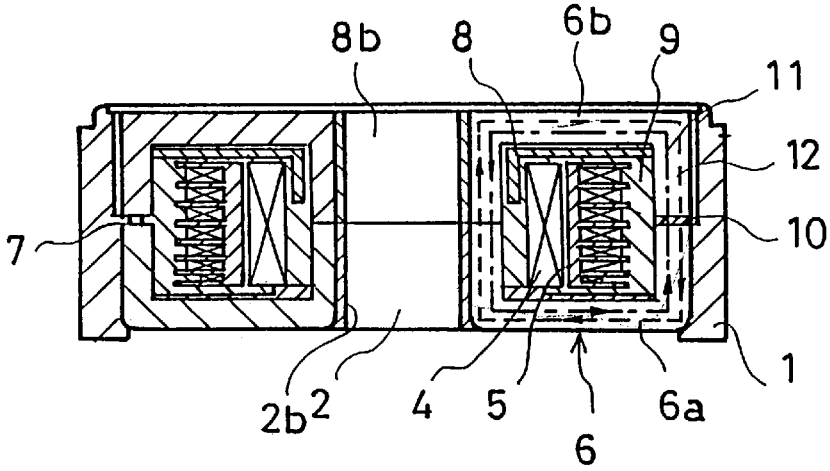
Figure 2A:
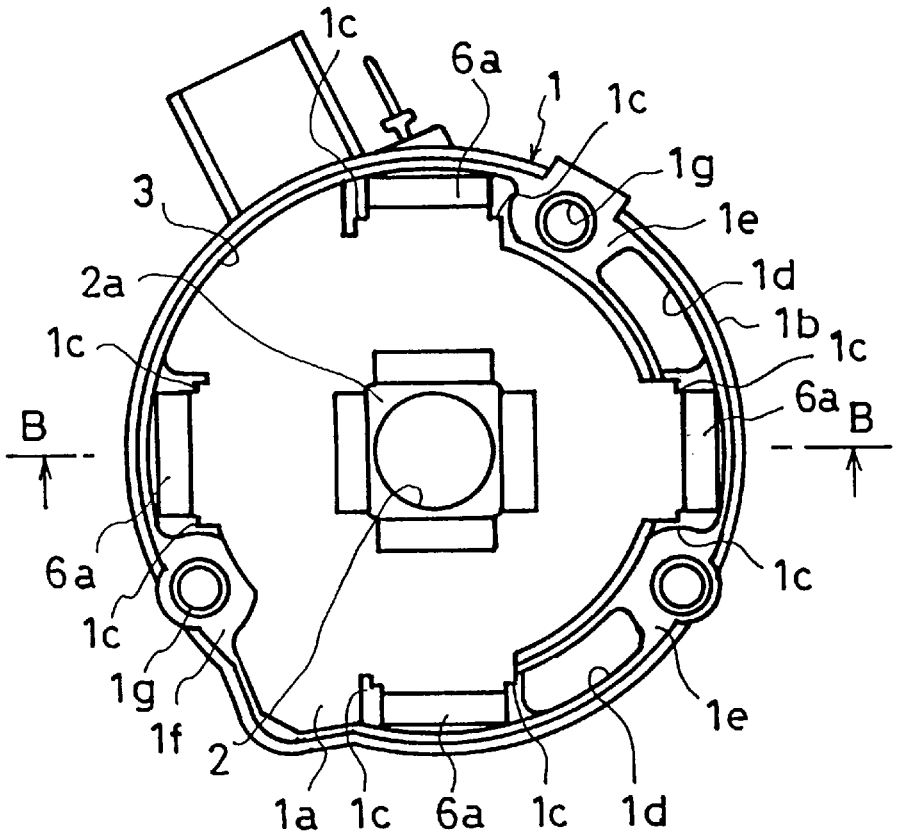
FIG. 2 is a diagram of the case of Embodiment 1.
Figure 2B:
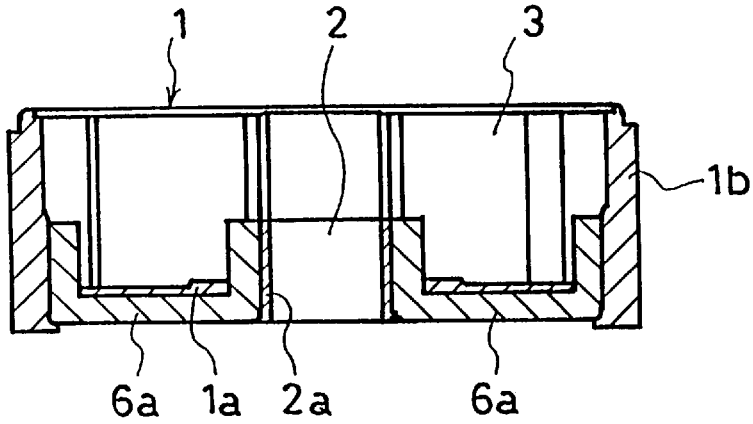
Figure 3A:
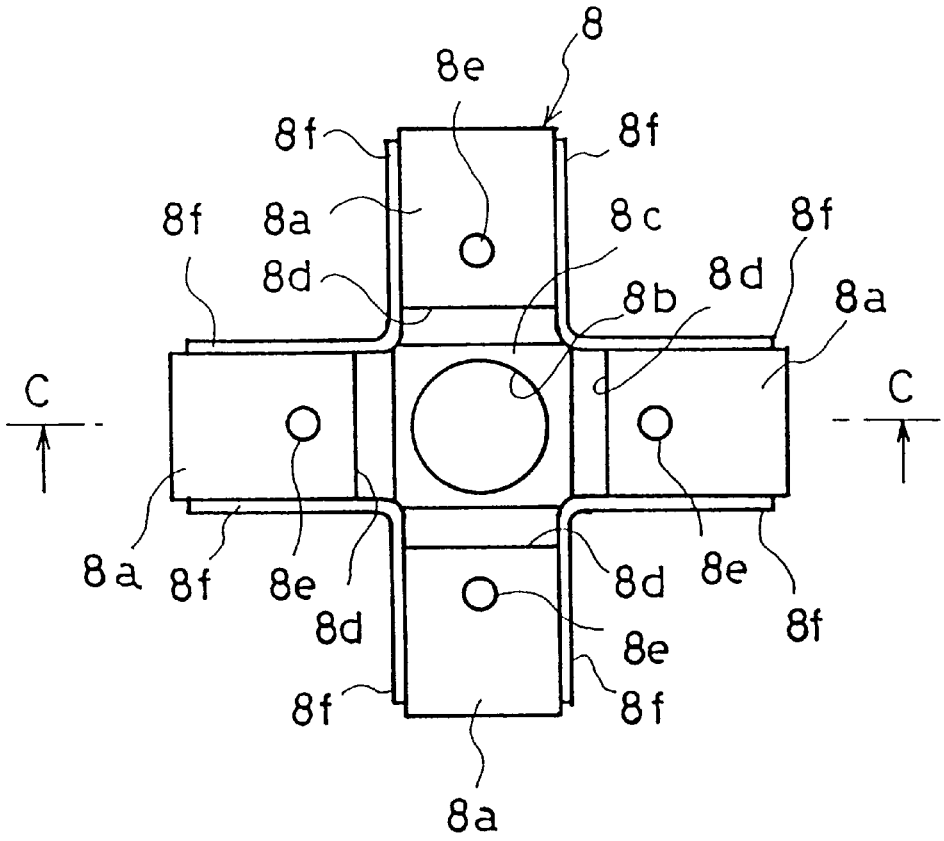
FIG. 3 is a diagram of the cover of Embodiment 1.
Figure 3B:
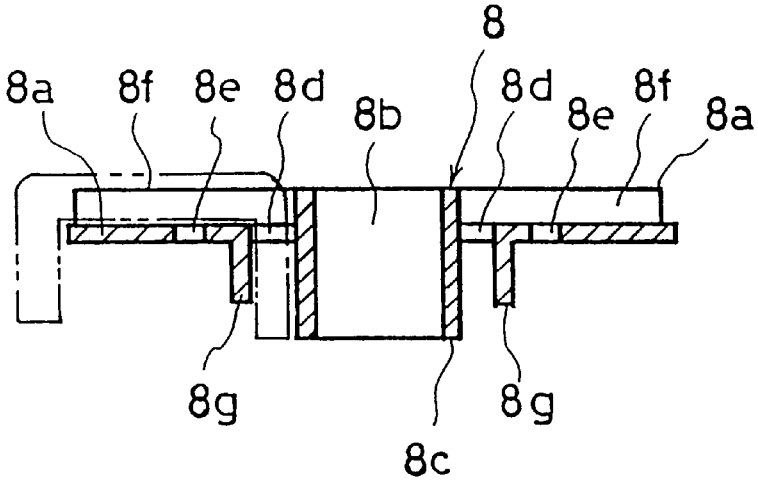

FIG. 1(*a*) is a plan view of an ignition coil apparatus according to Embodiment 1 of the invention. FIG. 1(*b*) is a sectional view cut on line A—A of FIG. 1(*a*). FIG. 2(*a*) is a plan view of a case used in the ignition col apparatus of Embodiment 1 and FIG. 2(*b*) is a sectional view cut on line B—B of FIG. 2(*a*). FIG. 3(*a*) is a plan view of a cover used in the ignition coil apparatus and FIG. 3(*b*) is a sectional view cut on line C—C of FIG. 3(*a*).

Figure 14A:
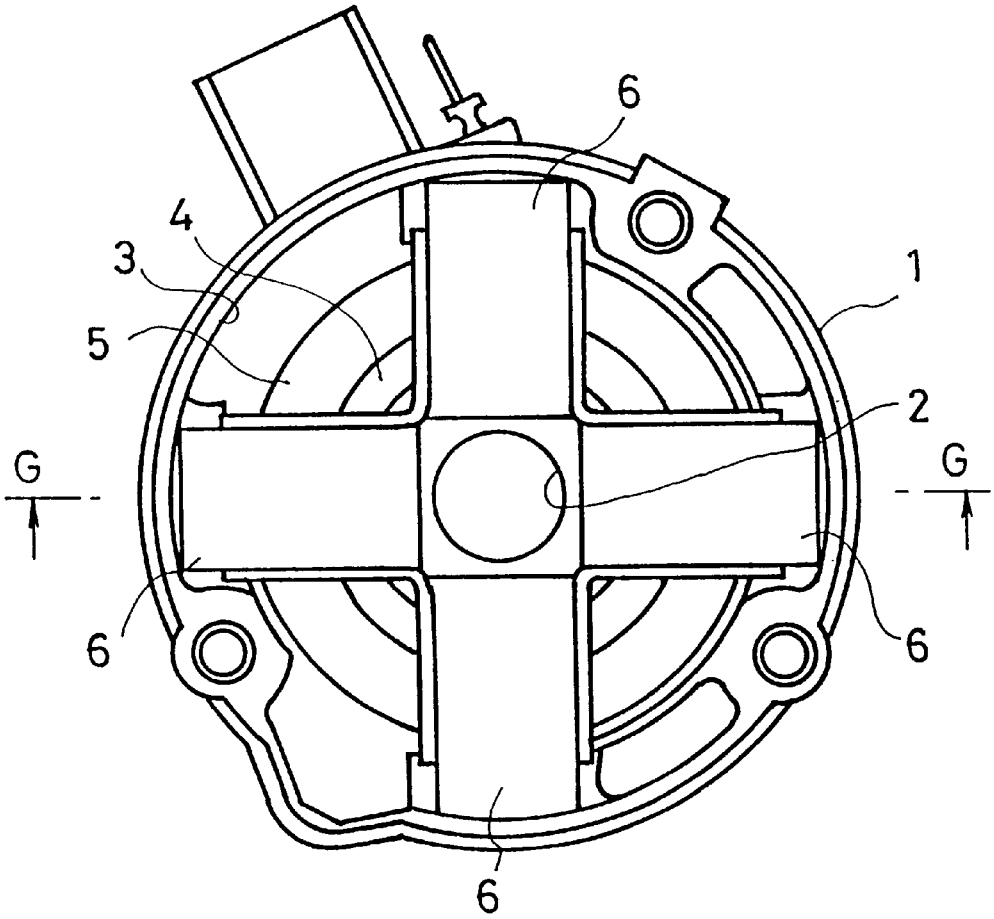
FIG.14(a) PRIOR ART
FIG. 14 is a sectional view of another ignition coil apparatus of the prior art.
Figure 14B:
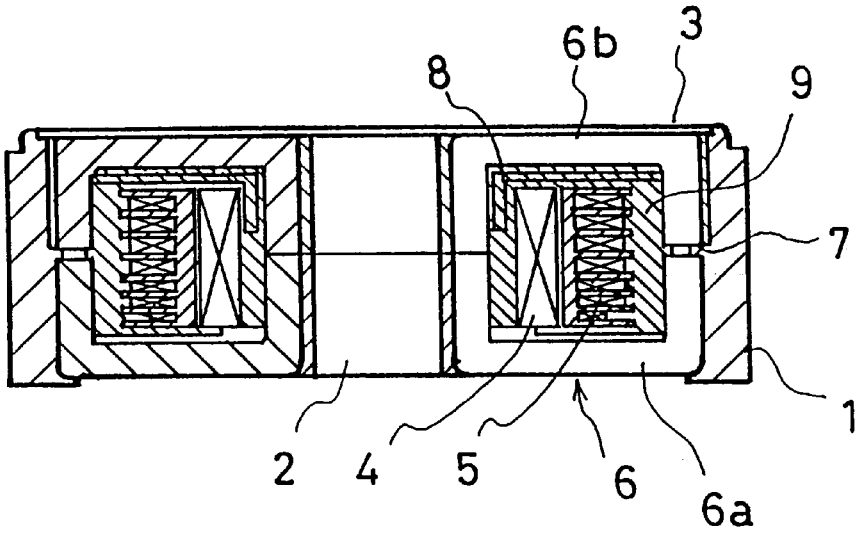
FIG.14(b) PRIOR ART

In FIG. 2, the case 1 used in the ignition coil apparatus of this Embodiment 1 is made of a synthetic resin and is cylindrical, having a bottom portion 1*a*. A hole 2 is formed at the center of the bottom portion of the case 1 to pass therethrough the shaft (see FIG. 14) which rotates in synchronization with the rotation of the internal combustion engine and a container 3 is formed by the wall 2*a* of the hole 2, and the bottom portion 1*a* and the outer wall 1*b* of the case 1. As the synthetic resin constituting the case 1, polybutylene terephthalate, for example, is used. A cut core 6*a* to be described later is integrated with the bottom portion 1*a* of the case 1 by insertion at the time when the case 1 is molded. In concrete terms, a back portion astride the two opposing feet of the cut core 6*a* is arranged on the bottom portion 1*a* of the case 1, the inner foot of the cut core 6*a* extends upward toward the opening of the case 1 from the bottom portion 1*a* along the outside surface of the hole wall 2*a*, the outer foot of the cut core 6*a* extends upward toward the opening of the case 1 along the inside surface of the outer wall 1*b* of the case, and the position of the end surface of the outer foot is lower than that of the inner foot by half of the vertical distance of the gap 7 shown in FIG. 1. On both sides of the outer foot in the circumferential direction of the case 1, there are provided position determination portions 1*c* made of the same material as the case 1, which extend toward the inside of the case 1 from the outer wall 1*b* of the case 1, as integrated parts of the case 1. Dams 1*e* having holes 1*d* with a bottom portion and made of the same material as the case 1 are formed in the area from the two position determination portions 1*c* located at the center of a right half of FIG. 2(*a*) to the position determination portions located at both sides of the case 1 in circumferential direction in order to reduce the use of the insulating resin 9 to be described later and the weight of the apparatus. Mounting portions 1*g* are formed by inserting metal cylinders when the case 1 is molded, at positions near one side of the dam 1*e* from the hole id in circumferential direction and in a dam if separate from the dam 1*e* and formed at a position near one side of the case 1 in circumferential direction.

In FIG. 3, the cover 8 used in the ignition coil apparatus of this Embodiment 1 is made of a synthetic resin and has four arms 8*a* which substantially cross one another when seen from top. At the center of the cover 8 where the four arms 8*a* cross one another, a hole 8*b* for passing therethrough the shaft (see FIG. 14) rotating in synchronization with the rotation of the internal combustion engine is formed in alignment with the hole 2 of the case 1 in vertical direction, and a hole 8*d* for passing therethrough the inner foot of the cut core 6*b* to be described later and indicated by an imaginary line in FIG. 3(*b*) is each formed at the root of the arm 8*a* connected to the hole wall 8*c* surrounding the hole 8*b*. A hole 8*e* for feeding the insulating resin 9 to be described later is each formed apart from the hole 8*d* and near the center of the arm 8*a*, and a side wall 8*f* is provided along both sides of the arm 8*a* and extends upward. The side wall 8*f* serves to keep the back portion of the cut core 6*b* from sliding in horizontal direction when it is placed over the arm 8*a*. Furthermore, the side walls 8*f* are connected with each other at the corner of the hole wall 8*c* in order to prevent the arm 8*a* from being bent. On one side of the hole 8*d* for passing the foot therethrough, as shown in FIG. 3(*b*), a reinforcement wall 8*g* extends downward to prevent the arm 8*a* from being bent. If both ends of this reinforcement wall 8*g* are connected to the under portion of the side wall 8*f*, the reinforcement wall 8*g* will further ensure the prevention of the arm 8*a* from being bent. The position of the end surface of the outer foot of the cut core 6*b* indicated by an imaginary line of FIG. 3(*b*) is lower than that of the inner foot by half of the vertical distance of the gap 7 shown in FIG. 1.

In FIG. 1, in the container 3 of the case 1, the primary coil 4 is arranged around the hole 2, the secondary coil 5 is arranged outside and coaxially with the primary coil 4, and a plurality of cores 6, for example, four cores 6, are arranged around the hole 2 at intervals of a right angle to cross-chain the primary coil 4 and the secondary coil 5. Each core 6 is composed of a pair of U-shaped cut cores 6*a* and 6*b* which are arranged at intervals of a right angle bestride the primary coil 4 and the secondary coil 5 from above and below, respectively, with the end surfaces of the cut cores facing each other, so that each of these cores 6 forms a ring shape to cross-chain the primary coil 4 and the secondary coil 5 at intervals of a right angle. The cut core 6*a* is integrated with the case 1 by insertion at the time when the case 1 is molded, whereas the cut core 6*b* is stored in the case 1 after the primary coil 4 and the secondary coil 5 are stored in the case 1. In concrete terms, the inner foot of the cut core 6*a* is interposed between the primary coil 4 and the hole wall 2*a* and the outer foot of the cut core 6*a* is interposed between the secondary coil 5 and the outer wall 1*a* by storing the primary coil 4 and the secondary coil 5 in the container 3. The inner foot of the cut core 6*b* is inserted between the primary coil 4 and the hole wall 2*a* from above and the end surface of the inner foot is placed in contact with the end surface of the inner foot of the cut core 6*a*. The outer foot of the cut core 6*b* is inserted between the secondary coil 5 and the outer wall 1*a*, and the gap 7 having a predetermined distance is formed between the end surface of the outer foot of the cut core 6*b* and the end surface of the outer foot of the cut core 6*a*.

This gap 7 is located between the outer end surfaces of a pair of the cut cores 6*a* and 6*b* constituting each core 6 and a permanent magnet is provided in one of the four gaps 7. This permanent magnet 10 is formed to have almost the same size as the gap 7, that is, a thickness equal to or smaller than the vertical distance of the gap 7. The plane area of the permanent magnet 10 is almost the same as that of the end surface of the cut core 6*a* or 6*b*. Due to the size relationship between the thickness and the plane area, the permanent magnet 10 is adsorbed to the end surface of the cut core 6*b* by its own magnetic force in the existing gap 7 of the core 6 in order not to impair the usability of parts constituting the ignition coil apparatus, and provides the cores 6 with a magnetic flux 12 indicated by a dotted line and opposite in direction to a magnetic flux 11 indicated by a single-dot chained line generated in the cores 6 while electricity is supplied to the primary coil 4. Since the location of this single permanent magnet 10 is invisible from the top of the ignition coil apparatus, FIG. 1(*a*) shows the location of the permanent magnet 10 using slant lines to provide a conceptional view thereof.

The extending ends of the four arms 8*a* of the cover 8 fit in the position determination portions 1*c* of the case 1, the inner foot of the cut core 6*b* is inserted into the hole 8*d* of the cover 8, the outer foot of the cut core 6*b* is inserted into the space between the arm 8*a* of the cover 8 and the outer wall 1*b* of the case 1, and the back portion of the cut core 6*b* is placed over the arm 8*a* of the cover 8, so that the cut core 6*b* straddles the primary coil 4 and the secondary coil 5 stored in the container 3. Thereby, the end surfaces of the cut core 6*b* are aligned in vertical direction along the center of the hole 2 with respect to the cut core 6*a*. After the cut core 6*b* is mounted astride the primary coil 4 and the secondary coil 5 stored in the container 3 through the cover 7, the insulating resin 9 such as an epoxy resin, for example, is poured into the container 3 and solidified. Since the insulating resin 9 poured into the container 3 flows into all the spaces among parts such as the primary coil 4, the secondary coil 5, the cover 8 and the permanent magnet 10, and also flows through the hole 8*e* of the cover 8 from upper to lower portion of the arm 8*a*, a plurality of parts stored in the container 3 are firmly fixed to the case 1 when the insulating resin 9 is solidified.

Therefore, in the ignition coil apparatus of this Embodiment 1, each time a primary current runs through the primary coil 4 at the time of igniting the internal combustion engine, the secondary coil 5 which is magnetically coupled to the primary coil 4 by the cores 6 generates a high voltage for igniting the internal combustion engine. At this time, since the permanent magnet 10 provides the cores 6 with the magnetic flux 12 opposite in direction to the magnetic flux 11 generated in the cores 6 while electricity is supplied to the primary coil 4, the magnetic flux 11 generated in the cores 6 by supplying electricity to the primary coil 3 cancels the magnetic flux 12 caused by the permanent magnet 10 and is grown into a saturated magnetic flux which is large enough to saturate the cores 6.

Consequently, the ignition coil apparatus of this Embodiment 1 has increased magnetic force stored in the cores 6 and raised output power from the secondary coil 5 compared with the case where the permanent magnet 10 is absent.

Figure 13:
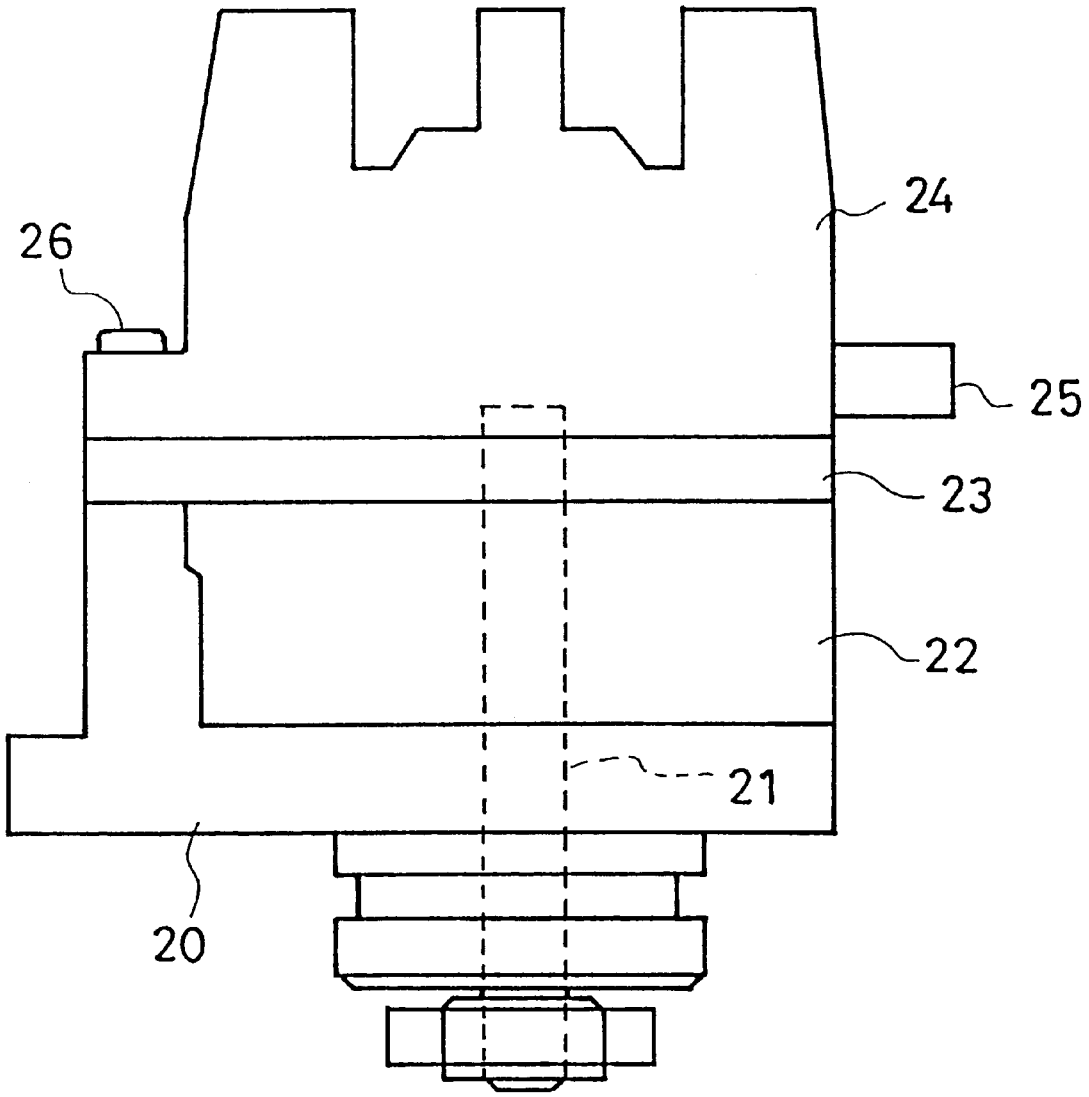
FIG. 13 PRIOR ART
FIG. 13 is a side view of a distributor of the prior art.

Moreover, since the ignition coil apparatus of this Embodiment 1 is structured such that the base, the electric unit and the gap are arranged around the shaft in tiers as shown in FIG. 13, and that a plurality of cores are arranged around the hole 2 at intervals of a right angle to cross-chain the primary coil 4 and the secondary coil 5 as shown in FIG. 1, the apparatus is mechanically excellent in volume efficiency and extremely effective in reducing the size of the distributor.

Furthermore, the ignition coil apparatus of this Embodiment 1 is structured such that the permanent magnet 10 is provided in one of the existing gaps 7 located on the outer sides of the plurality of cores 6, the least number of the permanent magnets is required without impairing the usability of the existing parts such as the case 1, the cover 8, the primary coil 4, the secondary coil 5 and the cores 6 constituting the ignition coil apparatus, and the number of parts does not increase. Moreover, the cut core 6*b* is inserted into a predetermined position of the container 3 from above while the permanent magnet 10 is adsorbed to the outer end surface of the other cut core 6*b* by its own magnetic force, whereby the permanent magnet is arranged in the above-mentioned single gap 7, resulting in almost no increase in the number of assembly steps for the ignition coil apparatus. In addition, the permanent magnet 10 is placed in the gap 7 and then fixed in the gap 7 by solidification of the insulating resin 9 so that the electromagnetic performance of the above-mentioned ignition coil apparatus is ensured effective for a prolonged period.

Embodiment 2

Figure 4A:
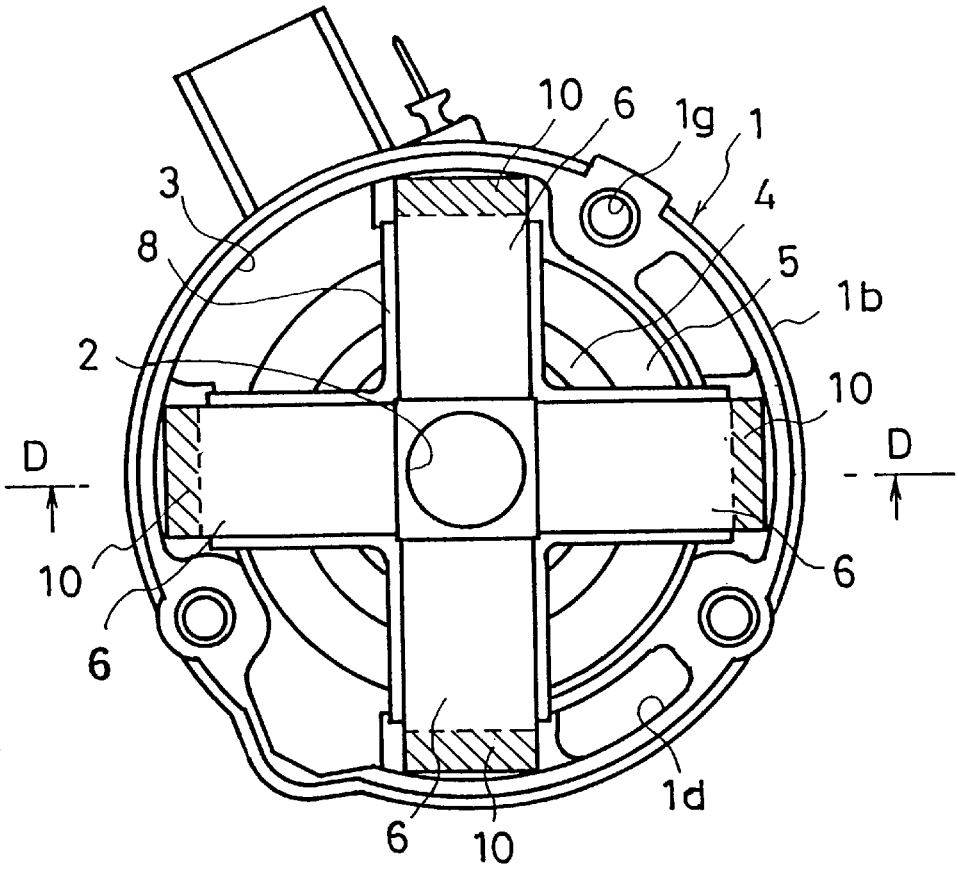
FIG. 4 is a diagram of an ignition coil apparatus according to Embodiment 2.
Figure 4B:
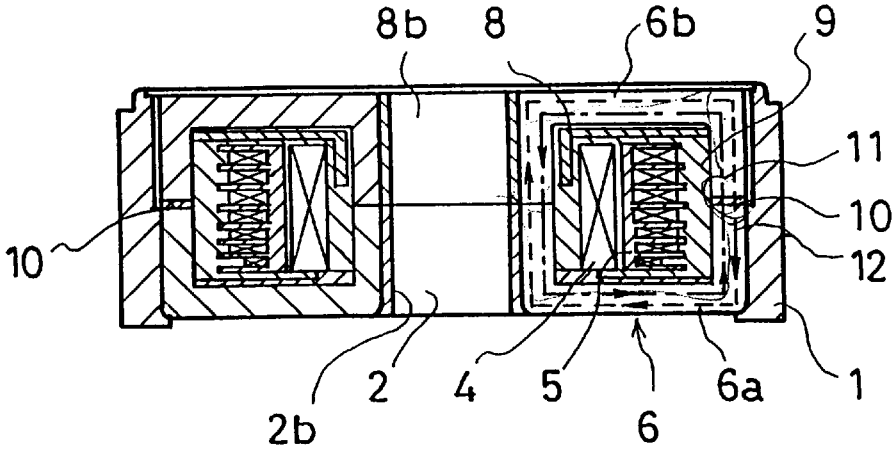

FIG. 4(*a*) is a plan view of an ignition coil apparatus according to Embodiment 2 of the invention, and FIG. 4(*b*) is a sectional view cut on a line D—D of FIG. 4(*a*). In FIG. 4, the ignition coil apparatus of this Embodiment 2 is characterized in that permanent magnets 10 are arranged in all the existing gaps 7, that is, four gaps 7 located on the outer sides of the plurality of cores 6. In concrete terms, parts constituting the ignition coil apparatus, such as the case 1, cover 8, primary coil 4, secondary coil 5 and cores 6 are the same as those of Embodiment 1. Four of the same permanent magnet as the permanent magnet 10 used in the above-described Embodiment 1 are used, and the cut core 6*b* is inserted into a predetermined position of the container 3 from above while each of the permanent magnets 10 is adsorbed to the outer end surface of the cut core 6*b* by its magnetic force so that the four permanent magnets 10 are arranged in the respective four gaps 7 as described above. Since the arrangement of the four permanent magnets 10 is not visible from top of the ignition coil apparatus, FIG. 4(*a*) shows the arrangement of the permanent magnets 10 using slant lines to provide a conceptional view thereof.

Therefore, in the ignition coil apparatus of this Embodiment 2, since the permanent magnets 10 are arranged in all the existing gaps 7 located on the outer sides of the plurality of cores 7, a saturated magnetic flux caused by the permanent magnets 10 and generated in the cores by supplying electricity to the primary coil 4 sharply increases by an increase in the number of permanent magnets 10, without impairing the usability of existing parts constituting the ignition coil apparatus, such as the case 1, cover 8, primary coil 4, secondary coil 5 and cores 6, in addition to the functions of the above-described Embodiment 1. This increased saturated magnetic flux is almost four times that of Embodiment 1, thereby greatly improving the electromagnetic performance of the ignition coil apparatus.

Embodiment 3

Figure 5:
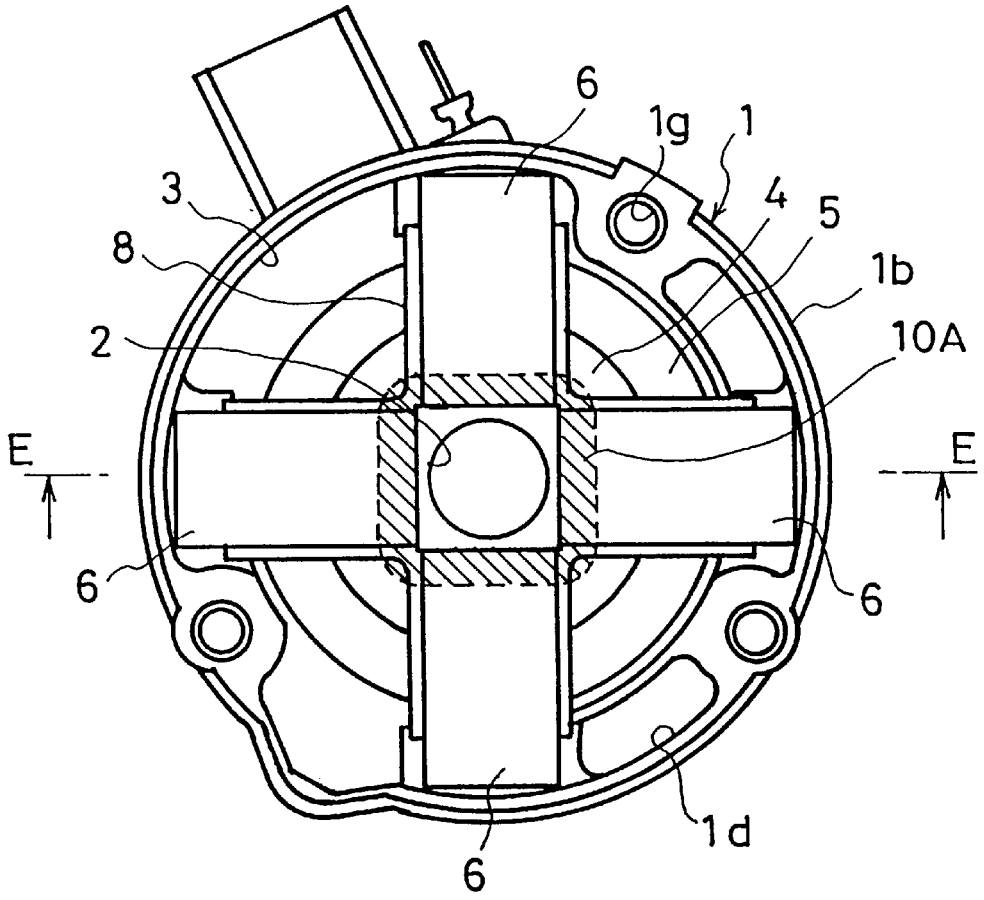
FIG. 5 is a diagram of an ignition coil apparatus according to Embodiment 3.
Figure 5:
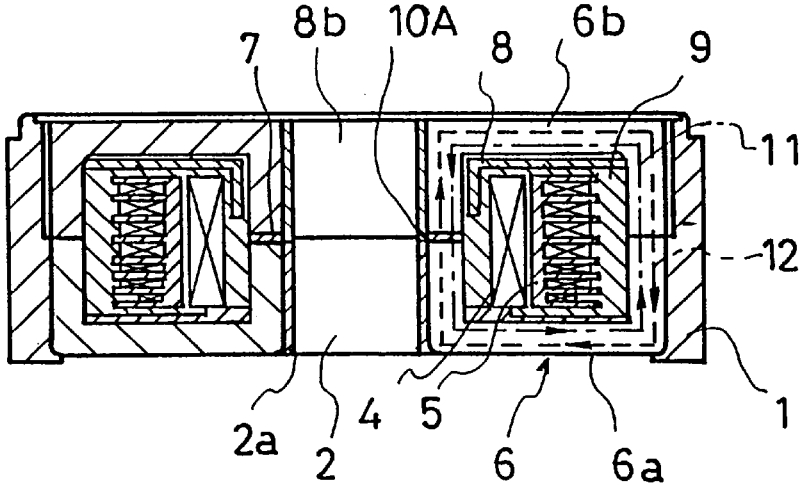
Figure 6A:
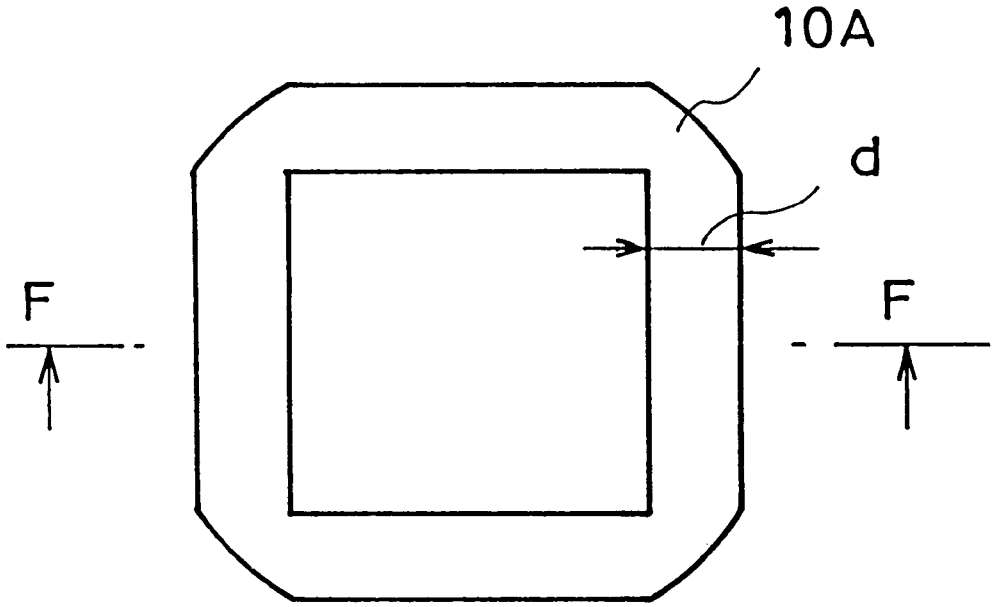
FIG. 6 is a diagram of the permanent magnet of Embodiment 3.
Figure 6B:
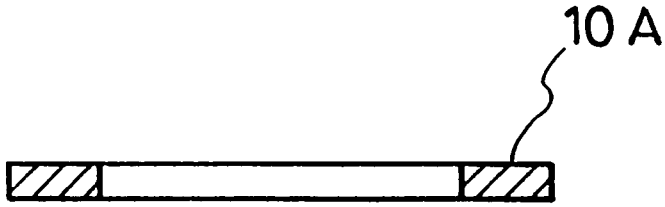

FIG. 5(*a*) is a plan view of an ignition coil apparatus according to Embodiment 3 and FIG. 5(*b*) is a sectional view cut on a line E—E of FIG. 5(*a*). FIG. 6(*a*) is a plan view of a permanent magnet used in the ignition coil apparatus of this Embodiment 3 and FIG. 6(*b*) is a sectional view cut on a line F—F of FIG. 6(*a*).

In FIG. 5, the ignition coil apparatus of this Embodiment 3 is characterized in that permanent magnets 10A are arranged in all the existing gaps 7, that is, the four gaps 7 located on the inner sides of the plurality of cores 6. In concrete terms, parts constituting the ignition coil apparatus, such as the case 1, cover 8, primary coil 4, secondary coil 5 and cores 6, are the same as those of the above-described Embodiment 1, but the gaps 7 are formed on the inner sides of the cores 6. To form the gaps 7 on the inner sides of the cores 6, in the case where the cut core 6*a* is integrated with the case 1 by insertion at the time when the case 1 is molded, when the cut core 6*a* is arranged at a cut-core insertion position of a mold for the case 1, a shorter foot of the cut core 6*a* is set as the inner side of the cut core 6*a* and a longer foot of the cut core 6*a* is set as the outer side. Meanwhile, when the cut core 6*b* is arranged to cover the primary coil 4 and the secondary coil 5 through the cover 8, a shorter foot of the cut core 6*b* is set as the inner side of the cut core 6*b* and goes through the hole 8*d* (see FIG. 3) of the cover 8 and a longer foot of the cut core 6*b* is set as the outer side.

In FIG. 6, the permanent magnet 10A is ring-shaped to enclose the hole wall 2*a* (see FIG. 5), when seen from top, the width d of a ring portion of the permanent magnet 10A is almost equal to the distance between the inner end and the outer end of the end surface of the cut core 6*b*, and the thickness of the ring portion is almost the same, that is, equal to or smaller than the vertical distance of the gap 7 when seen from its section.

Consequently, in the ignition coil apparatus of this Embodiment 3, before the cut cores 6*b* are attached to the case m and the cover 8 is attached to the case 1 in FIG. 5, the permanent magnet 10A is placed on the end surfaces of the inner feet of the cut cores 6*a* around the hole wall 2*a* and adsorbed to the end surfaces by its own magnetic force. Then the cover 8 is positioned determined and attached to the case 1 and the cut cores 6*b* are inserted into predetermined positions of the container 3 from above so that the one ring-shaped permanent magnet 1A is arranged in the four inner gaps 7. Since the arrangement of this permanent magnet 10A is not visible from top of the ignition coil apparatus, FIG. 5(*a*) shows the permanent magnet 10A using slant lines to provide a conceptional view thereof.

Therefore, in the ignition coil apparatus of this Embodiment 3, since a single ring-shaped permanent magnet 10A is arranged in all the existing gaps 7 located on the inner sides of the plurality of cores 6, the single permanent magnet 10A can provide the cores 6 with a magnetic flux 12 opposite in direction to a magnetic flux 11 generated in the plurality of cores 6 while electricity is supplied to the primary coil, without impairing the usability of parts constituting the ignition coil apparatus, such as the case 1, cover 8, primary coil 4, secondary coil 5 and cores 6, in addition to the function of the above-described Embodiment 1. In addition, the number of permanent magnets 10A is reduced, thereby making it possible to reduce the number of parts, assemble the ignition coil apparatus with ease, and increase a saturated magnetic flux caused by the permanent magnet 10A and generated in the cores 6 by supplying electricity to the primary coil 4. This increased saturated magnetic flux is almost four times that of Embodiment 1, thereby greatly improving the electromagnetic performance of the ignition coil apparatus.

Embodiment 4

Figure 7:
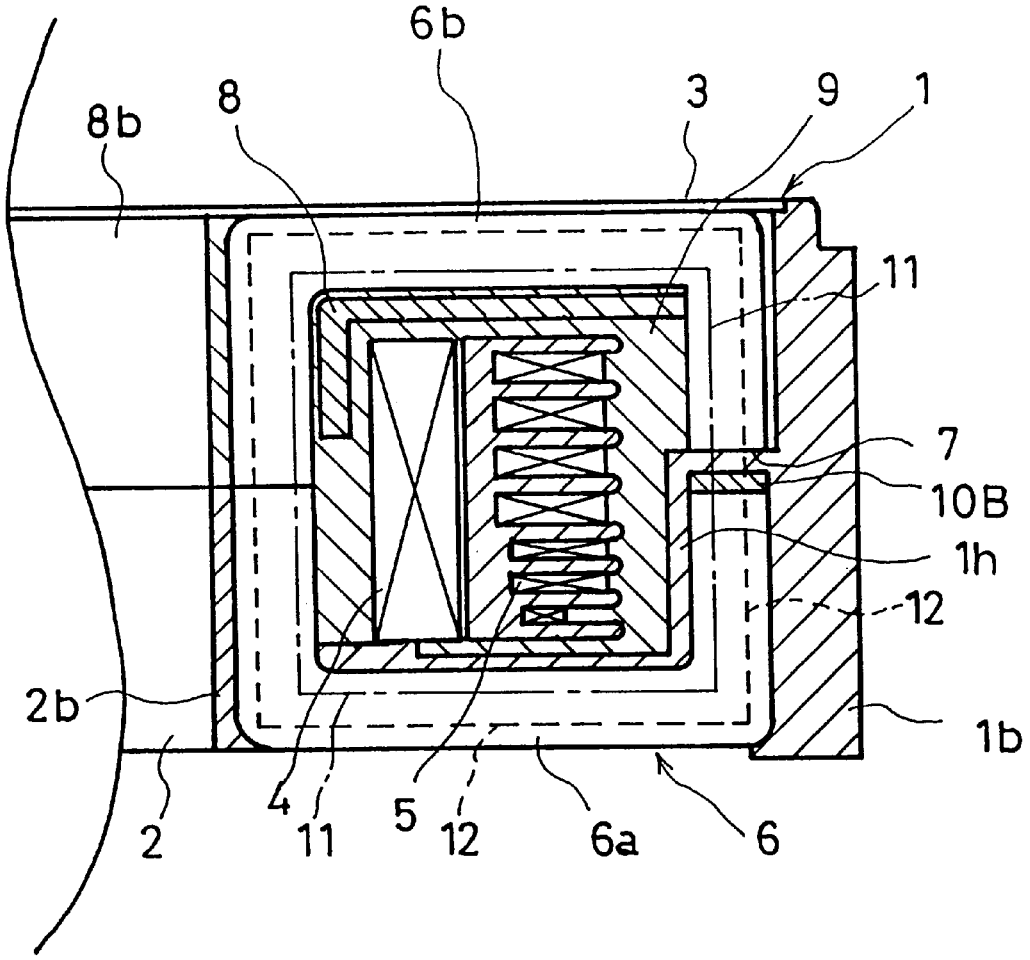
FIG. 7 is a sectional view of key parts of an ignition coil apparatus according to Embodiment 4.

FIG. 7 is a sectional view of key parts of an ignition coil apparatus according to Embodiment 4. In FIG. 7, the ignition coil apparatus of this Embodiment 4 is characterized in that the permanent magnet 10B is integrated with a resin molded part constituting the ignition coil apparatus, particularly that the permanent magnet 10B is integrated with the case 1 by insertion at the time when the case 1 is molded. In concrete terms, when the case 1 is molded, the permanent magnet 10B is adsorbed to a lower end surface of the cut core 6*a* by its own magnetic force, the cut core 6*a* is arranged at a cut-core arranging position of a case mold so that the foot to which the permanent magnet 10B is adsorbed is set as the outer side of the cut core 6*a*, and a synthetic resin as a molding material is poured into a cavity (space for molding the case) in the case mold to mold the case 1, so that the cut core 6*a* and the permanent magnet 10B are integrated with the case 1. By molding this case 1, part of the molding material of the case 1 flows along the outer wall 1*b* of the case 1 via the top surface of the permanent magnet 10B and the shorter foot of the cut core 6*a* to the back portion of the cut core 6*a*. The sum of the thickness (vertical distance of the support layer 1*h* in FIG. 7) of the support layer 1*h* covering the permanent magnet 10B and the thickness of the permanent magnet 10B is almost the same as the predetermined distance of the gap 7.

Therefore, to produce the ignition coil apparatus of this Embodiment 4, the case 1 containing the cut core 6*a* and the permanent magnet 10B is formed, the primary coil 4 and the secondary coil 5 are arranged around the hole 2 in the container 3 of the case 1, the cover 8 is position determined in the container 3, and the cut core 6*b* is inserted into the container 3 from above through the cover 8 to enclose the primary coil 4 and the secondary coil 5, so that the end surface of the longer foot of the cut core 6*b* is set as the inner side of the cut core 6*b* and placed in contact with the end surface of the inner foot of the cut core 6*a* whereas the end surface of the shorter foot of the cut core 6*b* is set as the outer side of the cut core 6*b* and placed in contact with the support layer 1*h*. Subsequently, the insulating resin 9 having fusability is poured into the container 3 and solidified to obtain an ignition coil apparatus.

In short, in the ignition coil apparatus of this Embodiment 4, since the permanent magnet 10B is integrated with the case 1, it is possible to check the polarity of the permanent magnet 10B as a part integrated with the case 1 and to prevent the occurrence of misinstallation of the permanent magnet 10B during the assembly of the ignition coil apparatus. Furthermore, since the permanent magnet 10B is covered with the support layer 1*h* formed of the molding material of the case 1, it is possible to improve damage prevention and handling properties of the permanent magnet 10B as compared with the case where the permanent magnet 10B is attached during the assembly of the apparatus.

Embodiment 5

Figure 8:
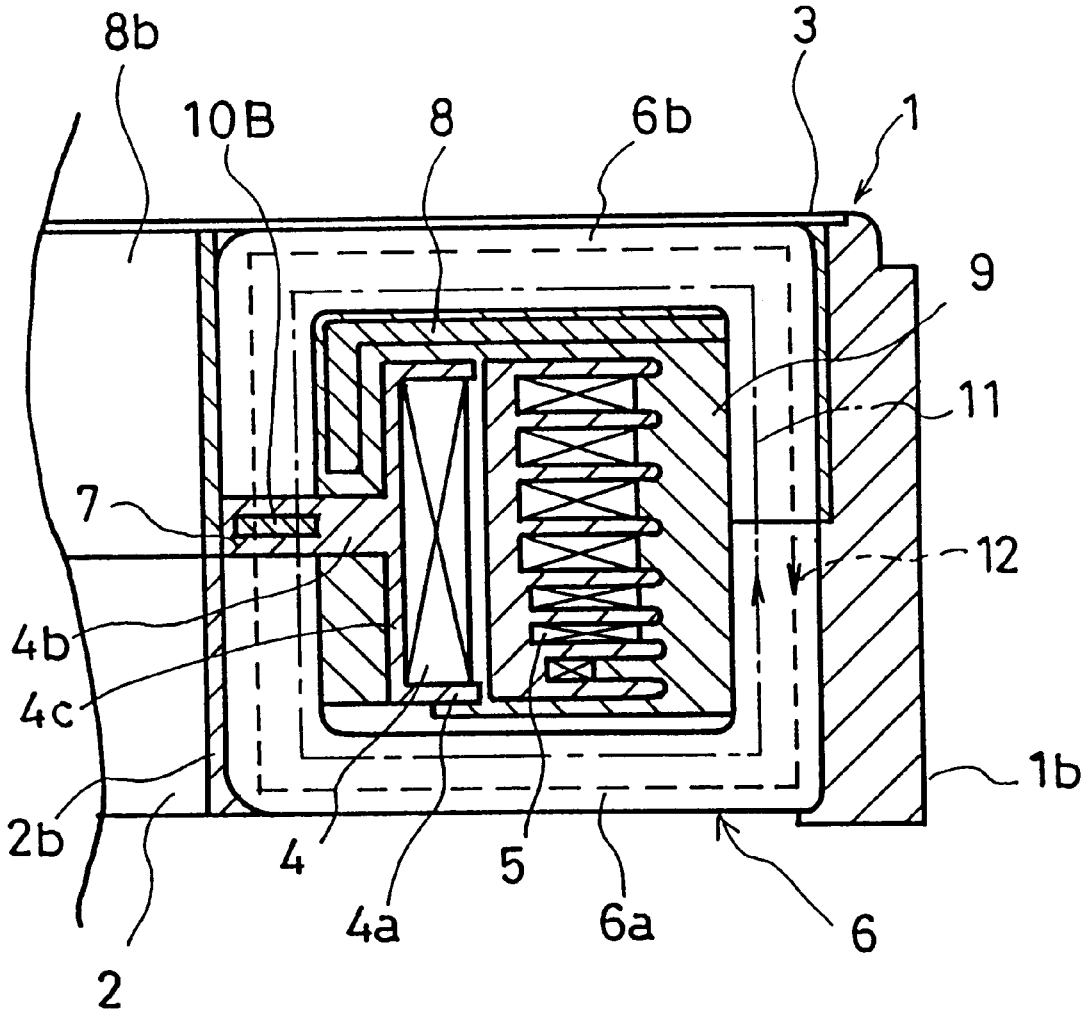
FIG. 8 is a sectional view of key parts of an ignition coil apparatus according to Embodiment 5.

FIG. 8 is a sectional view of key parts of an ignition coil apparatus according to Embodiment 5. In FIG. 8, like the above-described Embodiment 4, the ignition coil apparatus of this Embodiment 5 is characterized in that the permanent magnet 10B is integrated with a resin molded part which constitutes the ignition coil apparatus, particularly that the permanent magnet 10B is integrated with the synthetic resin bobbin 4*a* of the primary coil 4 by insertion at the time when the bobbin 4*a* is molded. In concrete terms, in the case of molding the bobbin 4*a*, the permanent magnet 10B is arranged in the cavity of a bobbin mold, and a synthetic resin as a molding material is poured into this cavity of the bobbin mold to mold the bobbin 4*a*, so that the permanent magnet is integrated with the bobbin 4*a*. This permanent magnet 10B is incorporated in the support layer 4*b* extending from the bobbin 4*a*. This support layer 4*b* extends from an intermediate portion of the wall of a center hole 4*c* formed in the bobbin 4*a* towards the inside of the case 1 and the extending end of the support layer 4*b* is arranged in the vicinity of the wall 2*a* surrounding the hole 2. The total thickness of this support layer 4*b* including the permanent magnet 10B in vertical direction is almost the same as the predetermined distance of the gap 7.

Therefore, to produce the ignition coil apparatus of this Embodiment 5, the bobbin 4*a* including the permanent magnet 10B is formed and a wire material for forming the primary coil 4 is wound around this bobbin 4*a* while the case 1 including the cut core 6*a* is formed, and the primary coil 4 is arranged coaxially in the container 3 of the case 1, so that the permanent magnet 10B is placed over the lower end surface of the cut core 6*a* through the support layer 4*b*. After the cover is position determined and placed in the container 3, the cut core 6*b* is inserted into the container from above through the cover 8 to enclose the primary coil 4 and the secondary coil 5, whereby the lower end surface of the cut core 6*b* is set as the inner side of the cut core 6*b* and placed into contact with the support layer 4*b* while the higher end surface of the cut core 6*b* is set as the outer side and placed into contact with the higher end surface of the cut core 6*a*. As a result, the permanent magnet 10B incorporated in the support layer 4*b* is positioned in the gap 7. Subsequently, the insulating resin 9 having fusability is poured into the container 3 and solidified to obtain an ignition coil apparatus.

In short, in the ignition coil apparatus of this Embodiment 5, since the permanent magnet 10B is integrated with the bobbin 4*a* of the primary coil 4, it is possible to check the polarity of the permanent magnet 10B as a part integrated with the bobbin 4*a* and to prevent the occurrence of misinstallation of the permanent magnet 10B during the assembly of the ignition coil apparatus. In addition, since the permanent magnet 10B is covered with the support layer 4*b*, it is possible to improve damage prevention and handling properties of the permanent magnet 10B compared with the case where the permanent magnet 10B is attached during the assembly of the apparatus.

Embodiment 6

Figure 9:
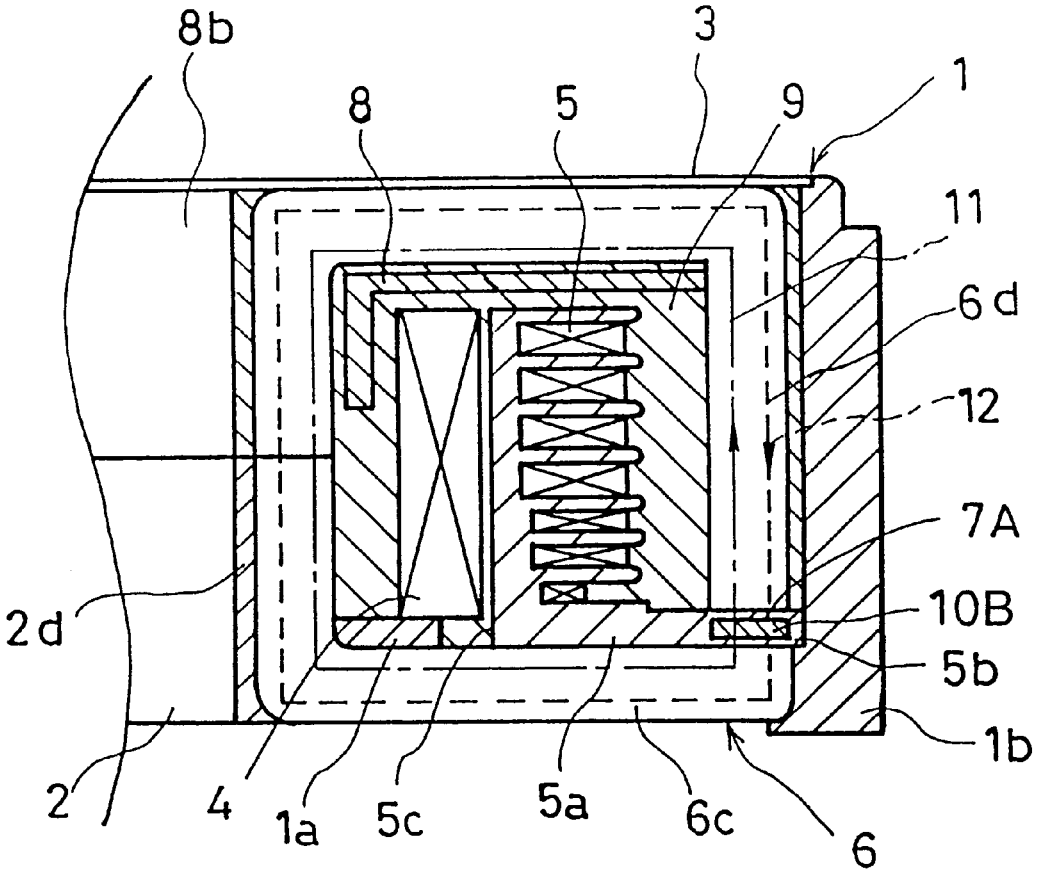
FIG. 9 is a sectional view of key parts of an ignition coil apparatus according to Embodiment 6.

FIG. 9 is a sectional view of key parts of an ignition coil apparatus according to Embodiment 6. In FIG. 9, like the above-described Embodiment 4, the ignition coil apparatus of this Embodiment 6 is characterized in that the the permanent magnet 10B is integrated with a resin molded part which constitutes the ignition coil apparatus, particularly that the permanent magnet 10B is integrated with the synthetic resin bobbin 5*a* of the secondary coil 5 by insertion at the time when the bobbin 5*a* is molded. In concrete terms, in the case of molding the bobbin 5*a*, the permanent magnet 10B is arranged in the cavity of a bobbin mold, and a synthetic resin as a molding material is poured into the cavity of the bobbin mold to mold the bobbin 5*a*, so that the permanent magnet 10B is integrated with the bobbin 5*a*. This permanent magnet 10B is incorporated in a support layer 5*b* extending from the bobbin 5*a*. This support layer 5*b* extends from a lower part of the wall of a center hole 5*c* formed in the bobbin 5*a* towards the outside and its extending end is placed in the vicinity of the outer wall 1*b* of the case 1. The total thickness of the support layer 5*b* including the permanent magnet 10B in vertical direction is almost the same as the predetermined distance of the gap 7A. This gap 7A is formed at a position where it can contain the support layer 5*b* including the permanent magnet 10*b* when the secondary coil 5 is stored in the container 3. In other words, a cut core 6*c* which is integrated with the case 1 has a back portion arranged on the bottom portion 1*a* of the case 1 and an inner foot extending upward from its back portion. A cut core 6*d* has a back portion arranged over the cover 8, an inner foot extending downward from its back portion and an outer foot extending downward from its back portion. This cut core 6*d* is inserted into the container 3 of the case 1 storing the primary coil 41 the secondary coil 5 and the cover 8 from above to straddle the primary coil 4 and the secondary coil 5, whereby the end surface of the inner foot of the cut core 6*d* is placed into contact with the end surface of the inner foot of the cut core 6*c*, the end surface of the outer foot of the cut core 6*d* is arranged to face the top surface of an outer end of the back portion of the cut core 6*c* with a space interposed therebetween, and the gap 7A having a predetermined distance is formed in the space between the the end surface of the outer foot of the cut core 6*d* and the outer end of the cut core 6*c*.

Therefore, to produce the ignition coil apparatus of this Embodiment 6, the bobbin 5*a* including the permanent magnet 10B is formed and a wire material for forming the secondary coil 5 is wound around the bobbin 5*a* to form the secondary coil 5 while the case 1 including the cut core 6*c* is formed, and the secondary coil 5 is arranged coaxially in the container 3 of the case 1 so that the permanent magnet 10B is placed over the top surface of the outer end of the back portion of the cut core 6*c* through the support layer 5*b*. After the cover is position determined and placed in the container 3, the cut core 6*d* is inserted into the container 3 through the cover 8 to enclose the primary coil 4 and the secondary coil 5, whereby the end surface of the inner foot of the cut core 6*d* is set as the inner side of the cut core 6*d* and placed into contact with the end surface of the inner foot of the cut core 6*c*, whereas the end surface of the outer foot of the cut core 6*d* is set as the outer side of the cut core 6*d* and placed into contact with the support layer 5*b*. As a result, the permanent magnet 10B incorporated in the support layer 5*b* is positioned in the gap 7A. Subsequently, an insulating resin 9 having fusability is poured into the container 3 and solidified to obtain an ignition coil apparatus.

In short, in the ignition coil apparatus of this Embodiment 6, since the permanent magnet 10B is integrated with the bobbin 5*a*, it is possible to check the polarity of the permanent magnet 10B as a part integrated with the bobbin 5*a* and to prevent the occurrence of misinstallation of the permanent magnet 10B during the assembly of the ignition coil apparatus. In addition, since the permanent magnet 10B is covered with the support layer 5*b*, it is possible to improve damage prevention and handling properties of the permanent magnet 10B compared with the case where the permanent magnet 10B is attached during the assembly of the apparatus.

Embodiment 7

Figure 10:
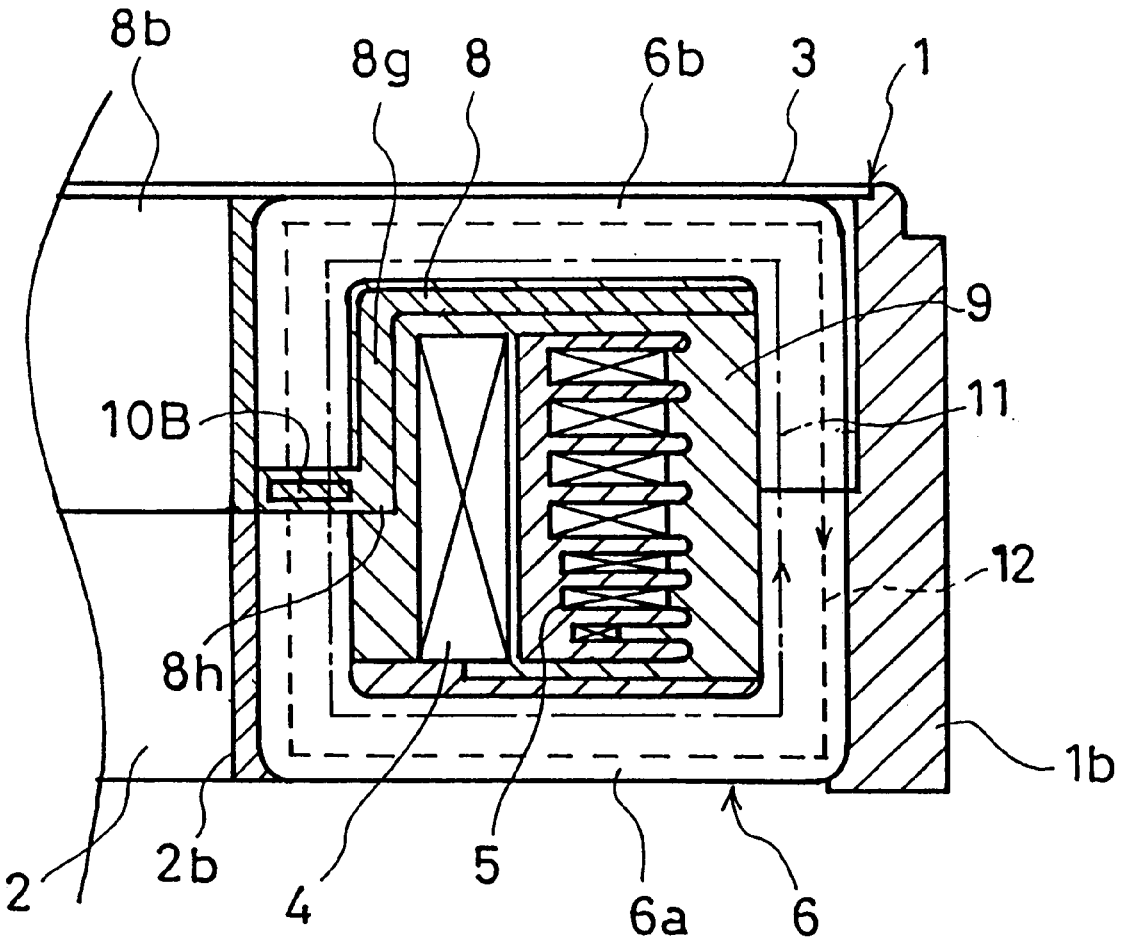
FIG. 10 is a sectional view of key parts of an ignition coil apparatus according to Embodiment 7.

FIG. 10 is a sectional view of key parts of an ignition coil apparatus according to Embodiment 7. In FIG. 10, like the above-described Embodiment 4, the ignition coil apparatus of this Embodiment 7 is characterized in that the permanent magnet 10B is integrated with a resin molded part which constitutes the ignition coil apparatus, particularly that the permanent magnet 10B is integrated with the synthetic resin cover 8 by insertion at the time when the cover 8 is molded. In concrete terms, in the case of molding the cover 8, the permanent magnet 10B is arranged in the cavity of a cover mold, and a synthetic resin as a molding material is poured into the cavity of the cover mold to mold the cover 8, so that the permanent magnet 10B is integrated with the cover 8. This permanent magnet 10B is incorporated in a support layer 8*h* extending from the cover 8. This support layer 8*h* extends from a lower end of a reinforcement wall 8*g* formed in the cover 8 towards the inside of the case 1 and its extending end is arranged in the vicinity of the hole wall 2*a* of the hole 2. The total thickness of the support layer 8*h* including the permanent magnet 10B in vertical direction is almost the same as the predetermined distance of the gap 7.

Therefore, to produce the ignition coil apparatus of this Embodiment 7, the cover 8 including the permanent magnet 10B is formed while the case 1 including the cut core 6*a* is formed, and the primary coil 4 and the secondary coil 5 are stored in the container 3 of this case 1. Thereafter, the cover 8 is position determined and placed in the container 3 so that the permanent magnet 10B is arranged over the lower end surface of the cut core 6*a* through the support layer 8*h*. The cut core 6*b* is inserted into the container 3 from above through the cover 8 to enclose the primary coil 4 and the secondary coil 5, whereby the lower end surface of the cut core 6*b* is set as the inside of the cut core 6*b* and placed into contact with the support layer 8*h* and the higher end surface of the cut core 6*b* is set as the outside and placed into contact with the higher end surface of the cut core 6*a*. As a result, the permanent magnet 10B incorporated in the support layer 8*h* is positioned in the gap 7. Subsequently, the insulating resin 9 having fusability is poured into the container 3 and solidified to obtain an ignition coil apparatus.

In short, in the ignition coil apparatus of this Embodiment 7, since the permanent magnet 10B is integrated with the cover 8, it is possible to check the polarity of the permanent magnet 10B as a part integrated with the cover 8 and to prevent the occurrence of misinstallation of the permanent magnet during the assembly of the ignition coil apparatus. In addition, since the permanent magnet 10B is covered with the support layer 8*h,* it is possible to improve damage prevention and handling properties of the permanent magnet 10B compared with the case where the permanent magnet 10B is attached during the assembly of the apparatus.

Embodiments 4 to 7 shown in FIGS. 7 to 10 wherein the permanent magnet 10B is arranged in a single gap 7 have been described with reference to the accompanying drawings. Not shown in the accompanying figures, another Embodiment can be implemented in which a plurality of the permanent magnet 10B are used and covered with one of the support layers 1*h,* 4*b*, 5*b* and 8*h* so that the plurality of permanent magnets 10B are positioned in a plurality of gaps 7.

Also, not shown in the accompanying figures, still another Embodiment can be implemented in which a single ring-shaped permanent magnet as shown in FIG. 6 is provided in place of the permanent magnet 10B and is covered with one of the support layers 1*h,* 4*b*, 5*b* and 8*h* so that it is positioned in all the gaps 7.

Embodiment 8

Figure 11:
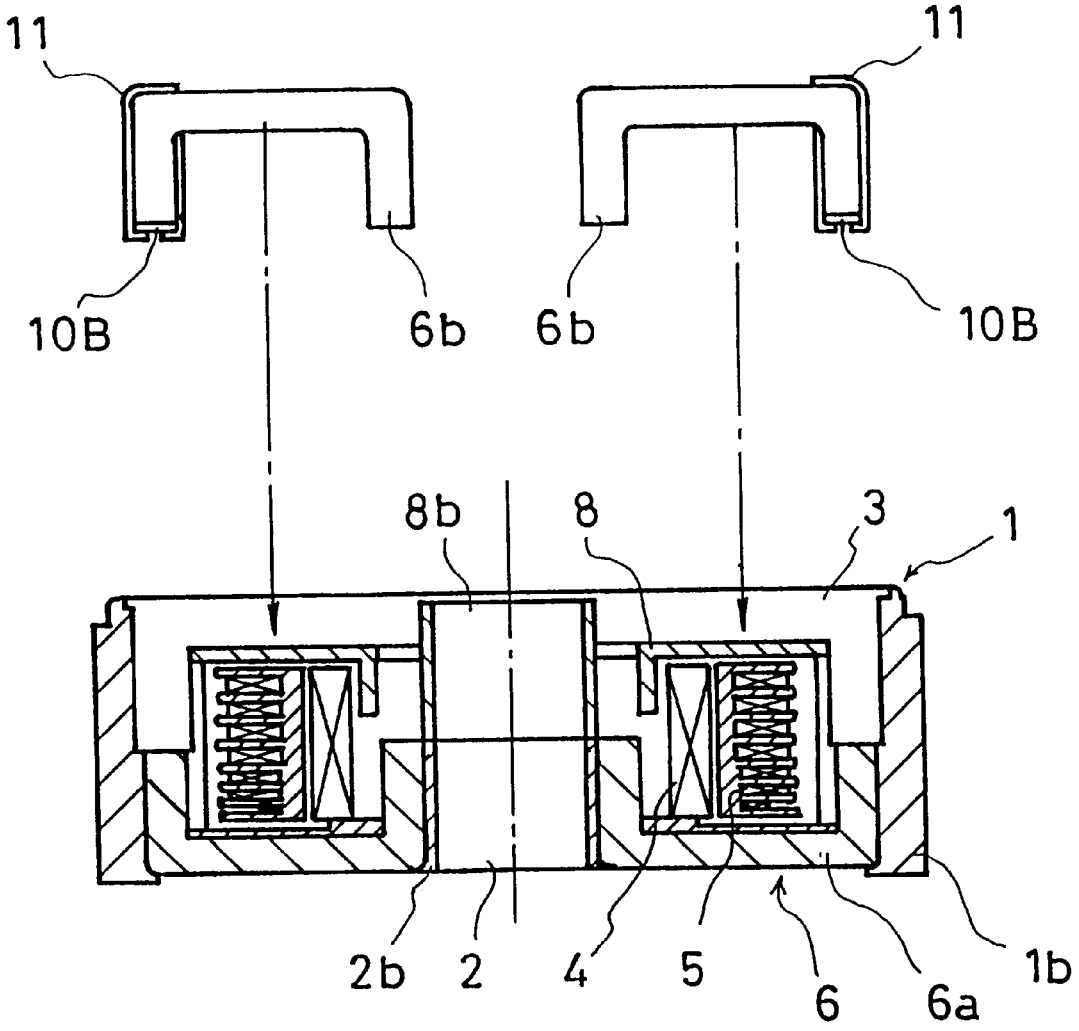
FIG. 11 is a sectional view of key parts of an ignition coil apparatus according to Embodiment 8.
Figure 12:
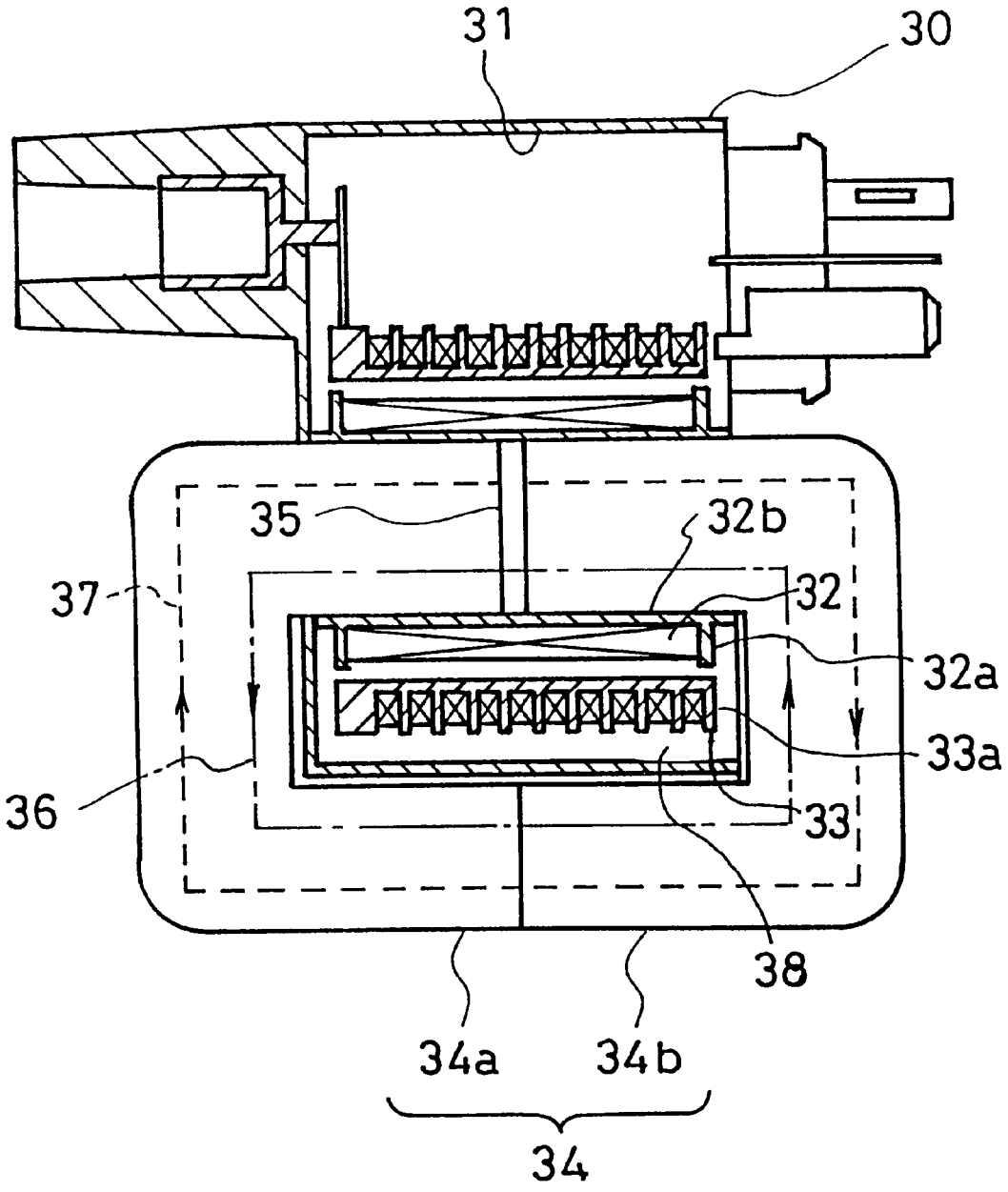
FIG. 12 PRIOR ART
FIG. 12 is a sectional view of an ignition coil apparatus of the prior art.

FIG. 11 is a sectional view of key parts of an ignition coil apparatus before the cut core is attached to the case according to Embodiment 8. In FIG. 11, the ignition coil apparatus of this Embodiment 8 is characterized in that the permanent magnet 10B is fixed to the core 6, particularly that the permanent magnet 10B is fixed to the cut core 6*b* to be attached to the case 1 later by the synthetic resin support layer 11. In concrete terms, the permanent magnet 10B is adsorbed to the lower end surface of the outer foot of the cut core 6*b* by its own magnetic force and the cut core 6*b* including this permanent magnet 10B is arranged in the cavity of a mold and a synthetic resin as a molding material for the support layer 11 is poured into this cavity to mold the support layer 11 so that the permanent magnet 10B is fixed to the cut core 6*b*. An intermediate portion of the bottom surface of the permanent magnet 10B is exposed from the support layer 11. The total distance from the end surface of the cut core 6*b* to the bottom surface of the support layer 11 including the permanent magnet 10B is made almost the same as the predetermined distance of the gap 7.

Therefore, to produce the ignition coil apparatus of this Embodiment 8, the cut core 6*b* to which the permanent magnet 10B is adhered by the support layer 11 is formed while the case 1 including the cut core 6*a* is formed, and the primary coil 4 and the secondary coil 5 are stored in the container 3 of this case 1. Thereafter, the cover 8 is positioned determined and the cut core 6*b* is inserted into the container 3 from above through the cover 8 to enclose the primary coil 4 and the secondary coil 5, whereby the higher end surface of the inner foot of the cut core 6*b* is set as the inner side of the cut core 6*b* and placed into contact with the higher end surface of the cut core 6*a*, while the support layer 11 fixing the permanent magnet 10B to the cut core 6*b* is set as the outer side and placed into contact with the lower end surface of the outer foot of the cut core 6*a*. As a result, the permanent magnet 10B fixed to the cut core 6*b* by the support layer 11 is positioned in the gap 7. Subsequently, the insulating resin 9 having fusability is poured into the container 3 and solidified to obtain an ignition coil apparatus.

In short, in the ignition coil apparatus of this Embodiment 8, since the permanent magnet 10B is fixed to the cut core 6*b* which constitutes the core 6, it is possible to check the polarity of the permanent magnet 10B as a part integrated with the cut core 6*b* and to prevent the occurrence of misinstallation of the permanent magnet 10B during the assembly of the ignition coil apparatus. In addition, since the permanent magnet is fixed to the cut core 6*b* by the support layer 11, the permanent magnet 10B is precisely positioned in the gap 7 without being dislocated with respect to the cut core 6*b* when the cut core 6*b* is installed in the container 3, thereby ensuring the saturated magnetic flux increasing function of the permanent magnet 10B for the cores 6. Furthermore, since the permanent magnet 10B is covered with the support layer 11, it is possible to improve damage prevention and handling properties of the permanent magnet 10B compared with the case where the permanent magnet 10B is attached during the assembly of the apparatus.

This Embodiment 8 in which the permanent magnet 10B is fixed to the cut core 6*b* by the support layer 11 made of a synthetic resin has been described with reference to the accompanying figure. Although not shown in the accompanying figure, the permanent magnet 10B has the same effect as when it is fixed to the end surface of the cut core 6*b* by an adhesive.

Embodiment 9

The above-described Embodiments 1 to 8 in which the permanent magnets 10 and 10B prepared by magnetizing a magnetic material are used have been described with reference to the accompanying drawings. In this Embodiment 9, after a magnetic material having the same shape as the permanent magnets 10 and 10B is attached to a part constituting the ignition coil apparatus or after the magnetic material is used to assemble an ignition coil apparatus, the magnetic material is magnetized to form a permanent magnet. As a result, according to this Embodiment 9, it is possible to improve installation ease of the magnetic material because the non-magnetized magnetic material is installed easier than the permanent magnets 10 and 10B and to prevent misinstallation caused by a mistake in checking the polarity of the permanent magnets 10 and 10B.

Embodiment 10

Although not shown in the accompanying figure, Embodiment 10 is characterized in that a rare earth metal is used as a magnetic material for the permanent magnet 10B in the above-described Embodiments 1 to 9 to improve the coercive force of the permanent magnets 10 and 10B.

In FIGS. 1 to 14, portions of the section of the core not indicated by slant lines are intended to clearly show magnetic fluxes indicated by one-dot chained lines and dotted lines.

According to the first aspect of the invention, since a permanent magnet is arranged in at least one magnetic circuit of a plurality of cores, the plurality of cores which are stored in the container formed in the synthetic resin case and arranged around and coaxially with the hole for passing therethrough the shaft rotating in synchronization with the rotation of an internal combustion engine are able to cancel a magnetic flux caused by the permanent magnet by supplying electricity to the primary coil, and to generate a saturated magnetic flux which is large enough to saturate the cores. In addition, it is possible to reduce the number of required permanent magnets as well as the number of parts and the number of assembly steps.

According to the second aspect of the invention, since the permanent magnet is arranged in all the magnetic circuits of a plurality of cores, the cores are able to cancel a magnetic flux caused by the permanent magnet by supplying electricity to the primary coil and to generate the maximum saturated magnetic flux which is large enough to saturate the core.

According to the third aspect of the invention, since the permanent magnet is arranged in the gap formed between the opposing end surfaces of the cut cores, it is possible to provide an electromagnetically excellent small-sized ignition coil apparatus without impairing the usability of existing components.

According to the fourth aspect of the invention, since the permanent magnet is located on the inner side of the apparatus when seen from the primary coil, a single ring-shaped permanent magnet can be arranged in the magnetic circuits of a plurality of cores.

According to the fifth aspect of the invention, since the permanent magnet is located on the outer side of the apparatus when seen from the primary coil, it is easy to provide an ignition coil apparatus using existing components.

According to the sixth aspect of the invention, since the permanent magnet is integrated with a synthetic resin molded part of an ignition coil, it is possible to improve handling and assembly ease of the permanent magnet.

According to the seventh aspect of the invention, since the permanent magnet is pre-fixed to the cut core by means other than its own magnetic force, it is possible to reduce the number of assembly steps, improve handling ease of the permanent magnet and prevent the occurrence of misinstallation of the permanent magnet during assembly of the ignition coil apparatus.

According to the eighth aspect of the invention, since a magnetic material is incorporated and then magnetized, it is possible to improve handling ease of the permanent magnet and prevent the occurrence of misinstallation of the permanent magnet during assembly of the ignition coil apparatus.

According to the ninth aspect of the invention, since the magnetic material of the permanent magnet is a rare earth metal, it is possible to suppress demagnetization of the permanent magnet and ensure reliability thereof.

According to the tenth aspect of the invention, it is possible to obtain an electromagnetically excellent ignition coil apparatus with ease by adding the simple step of adsorbing the permanent magnet to the end surface of the cut core to the steps of the existing production method.

What is claimed is:

1. An ignition coil apparatus for an internal combustion engine comprising:

a synthetic resin case having a cylindrically shaped partition that forms a hole for passing therethrough a shaft rotating in synchronization with the rotation of the internal combustion engine, a base wall that has an annular shape and that is disposed adjacent to said partition and extends radially outward from said hole, and a cylindrical outer wall that is disposed adjacent to an outer periphery of said base wall and faces said partition, wherein a container is formed by said partition, said base wall, and said outer wall;

a primary coil which is stored in the container and arranged around and coaxially with the hole, wherein the primary coil has a substantially cylindrical shape;

a secondary coil that is disposed in said container and is arranged coaxially with said hole such that said secondary coil is placed between said primary coil and said outer wall, wherein said secondary coil has a substantially cylindrical shape;

cores, which are stored in the container around the hole at equal intervals in a circumferential direction of the primary and secondary coils and which form a plurality of magnetic circuits for magnetically coupling the primary and secondary coils by supplying electricity to the primary coil, wherein said cores extend inside said primary coil along an axial direction of said primary coil, extend along remote axial ends of said primary coil and said secondary coil, and extend outside said secondary coil along an axial direction of said secondary coil such that said cores substantially encircle said primary coil and said secondary coil;

permanent magnets which are respectively arranged in all of the magnetic circuits formed by the plurality of cores to provide the cores with a magnetic flux opposite in direction to the magnetic flux of the magnetic circuits; and an insulating resin which is poured into spaces that are formed by storing the primary and secondary coils and the plurality of cores in the container and is solidified to secure at least the primary and secondary coils and the plurality of cores within the case;

wherein each of the plurality of cores comprises a pair of cut cores and one of first end surfaces and second end surfaces of said cut cores are placed between said partition and an inner circumference of said primary coil and another of said first end surfaces and second end surfaces of said cut cores are placed between said outer wall and an outer circumference of said secondary coil, wherein said first end surfaces of the pair of cut cores are placed in contact with each other, wherein said second end surfaces of the pair of cut cores are spaced apart from each other to form a gap having a predetermined distance therebetween, wherein said permanent magnets are respectively arranged in all of the gaps, and wherein the gaps are provided inside the container.

2. The ignition coil apparatus for an internal combustion engine according to claim 1, wherein the permanent magnets are arranged such that the primary coil is disposed between said permanent magnets and said hole.

3. The ignition coil apparatus for an internal combustion engine according to claim 1, wherein the permanent magnets are respectively pre-fixed to the second end surfaces of the cut cores by means other than its own magnetic force.

4. The ignition coil apparatus for an internal combustion engine according to claim 1, wherein the permanent magnets are prepared by respectively magnetizing magnetic materials after the magnetic materials are integrated with at least one component of the ignition coil apparatus or after the ignition coil apparatus is assembled.

5. The ignition coil apparatus for an internal combustion engine according to claim 1, wherein a magnetic material of the permanent magnets is a rare earth metal.

6. The ignition coil apparatus as claimed in claim 1, wherein said insulating resin is poured into spaces that are formed by storing the primary and secondary coils, the plurality of cores, and the permanent magnets in the container and is solidified to secure at least the primary and secondary coils and the plurality of cores within the case.

7. The ignition coil apparatus for an internal combustion engine according to claim 1, further comprising:

at least one synthetic resin molded part, wherein the permanent magnets are integrated with and held in said gaps by said at least one synthetic resin molded part.

8. The ignition coil apparatus for an internal combustion engine according to claim 7, wherein said at least one synthetic resin molded part comprises a first synthetic resin molded part which is disposed adjacent to at least two sides of at least a first magnet of said permanent magnets for integrating said first magnet.

9. The ignition coil apparatus for an internal combustion engine according to claim 8, wherein said at least two sides of said first magnet are contiguous.

10. The ignition coil apparatus for an internal combustion engine according to claim 7, wherein said at least one synthetic resin molded part comprises a first synthetic resin molded part which is disposed adjacent to at least three sides of at least a first magnet of said permanent magnets for integrating said first magnet.

11. The ignition coil apparatus for an internal combustion engine according to claim 7, wherein said at least one synthetic resin molded part is integral with said synthetic resin case.

12. The ignition coil apparatus for an internal combustion engine according to claim 8, wherein said first synthetic resin molded part is integral with said synthetic resin case.

13. The ignition coil apparatus for an internal combustion engine according to claim 10, wherein said first synthetic resin molded part is integral with said synthetic resin case.

14. An ignition coil apparatus for an internal combustion engine comprising:

a synthetic resin case having a cylindrically shaped partition that forms a hole for passing therethrough a shaft rotating in synchronization with the rotation of the internal combustion engine, a base wall that has an annular shape and that is disposed adjacent to said partition and extends radially outward from said hole, and a cylindrical outer wall that is disposed adjacent to an outer periphery of said base wall, wherein a container is formed by said partition, said base wall, and said outer wall;

a primary coil which is stored in the container and arranged around and coaxially with the hole, wherein the primary coil has a substantially cylindrical shape;

a secondary coil that is disposed in said container and is arranged coaxially with said hole such that said secondary coil is placed between said primary coil and said outer wall, wherein said secondary coil has a substantially cylindrical shape;

cores, which are stored in the container around the hole at equal intervals in a circumferential direction of the primary and secondary coils and which form a plurality of magnetic circuits for magnetically coupling the primary and secondary coils by supplying electricity to the primary coil, wherein said cores extend inside said primary coil along an axial direction of said primary coil, extend along remote axial ends of said primary coil and said secondary coil, and extend outside said secondary coil along an axial direction of said secondary coil such that said cores substantially encircle said primary coil and said secondary coil;

a permanent magnet arrangement which is arranged in all of the magnetic circuits formed by the plurality of cores to provide the cores with a magnetic flux opposite in direction to the magnetic flux of the magnetic circuits; and an insulating resin which is poured into spaces that are formed by storing the primary and secondary coils and the plurality of cores in the container and is solidified to secure the primary and secondary coils and the plurality of cores within the case;

wherein each of the plurality of cores comprises a pair of cut cores and one of first end surfaces and second end surfaces of said cut cores are placed between said partition and an inner circumference of said primary coil and another of said first end surfaces and second end surfaces of said cut cores are placed between said outer wall and an outer circumference of said secondary coil, wherein said first end surfaces of the pair of cut cores are placed in contact with each other, wherein said second end surfaces of the pair of cut cores are spaced apart from each other to form a gap having a predetermined distance therebetween, wherein said permanent magnet arrangement is arranged in all of the gaps, and wherein the gaps are provided inside the container.

15. The ignition coil apparatus for an internal combustion engine according to claim 14, wherein said permanent magnet arrangement comprises a plurality of permanent magnets which are equal in number to said gaps and wherein said permanent magnets are respectively disposed in said gaps.

16. The ignition coil apparatus for an internal combustion engine according to claim 14, further comprising:

at least one synthetic resin molded part, wherein the permanent magnet arrangement is integrated with and held in said gaps by said at least one synthetic resin molded part.

17. The ignition coil apparatus for an internal combustion engine according to claim 14, wherein the permanent magnet arrangement is pre-fixed to the second end surfaces of the cut cores by means other than its own magnetic force.

18. The ignition coil apparatus for an internal combustion engine according to claim 14, wherein the permanent magnet arrangement is prepared by respectively magnetizing magnetic materials after the magnetic materials are integrated with at least one component of the ignition coil apparatus or after the ignition coil apparatus is assembled.

19. The ignition coil apparatus for an internal combustion engine according to claim 14, wherein a magnetic material of the permanent magnet arrangement is a rare earth metal.

20. The ignition coil apparatus for an internal combustion engine according to claim 16, wherein said at least one synthetic resin molded part comprises a first synthetic resin molded part which is disposed adjacent to at least two sides of said permanent magnet arrangement for integrating said permanent magnet arrangement.

21. The ignition coil apparatus for an internal combustion engine according to claim 20, wherein said at least two sides of said permanent magnet arrangement are contiguous.

22. The ignition coil apparatus for an internal combustion engine according to claim 16, wherein said at least one synthetic resin molded part comprises a first synthetic resin molded part which is disposed adjacent to at least three sides of said permanent magnet arrangement for integrating said permanent magnet arrangement.

23. The ignition coil apparatus for an internal combustion engine according to claim 16, wherein said at least one synthetic resin molded part is integral with said synthetic resin case.

24. The ignition coil apparatus for an internal combustion engine according to claim 20, wherein said first synthetic resin molded part is integral with said synthetic resin case.

25. The ignition coil apparatus for an internal combustion engine according to claim 22, wherein said first synthetic resin molded part is integral with said synthetic resin case.

26. An ignition coil apparatus for an internal combustion engine comprising:

a synthetic resin case having a cylindrically shaped partition that forms a hole for passing therethrough a shaft rotating in synchronization with the rotation of the internal combustion engine, a base wall that has an annular shape and that is disposed adjacent to said partition and extends radially outward from said hole, and a cylindrical outer wall that is disposed adjacent to an outer periphery of said base wall, wherein a container is formed by said partition, said base wall, and said outer wall;

a primary coil which is provided in the container and arranged around and coaxially with the hole;

a secondary coil that is disposed in said container and is arranged coaxially with said hole such that said secondary coil is placed between said primary coil and said outer wall;

a core, which is provided in the container and which forms a magnetic circuit for magnetically coupling the primary and secondary coils by supplying electricity to the primary coil, wherein said core extends inside said primary coil along an axial direction of said primary coil, extends along remote axial ends of said primary coil and said secondary coil, and extends outside said secondary coil along an axial direction of said secondary coil such that said core substantially encircles said primary coil and said secondary coil, wherein the core comprises a pair of cut cores and one of first end surfaces and second end surfaces of said cut cores are placed between said partition and an inner circumference of said primary coil and another of said first end surfaces and second end surfaces of said cut cores are placed between said outer wall and an outer circumference of said secondary coil, wherein said first end surfaces of the pair of cut cores are placed in contact with each other, and wherein said second end surfaces of the pair of cut cores are spaced apart from each other to form a gap having a predetermined distance therebetween;

a permanent magnet provided in the gap;

an insulating resin which is poured into spaces that are formed by storing the primary and secondary coils and the core in the container and is solidified to secure the primary and secondary coils and the core within the case;

a synthetic resin molded part disposed between at least one of said second end surfaces and said permanent magnet for holding said permanent magnet in said gap.

27. The ignition coil apparatus as claimed in claim 26, wherein said synthetic resin molded part is disposed adjacent to at least two contiguous sides of said permanent magnet.

28. The ignition coil apparatus as claimed in claim 26, wherein said synthetic resin molded part is disposed adjacent to at least three contiguous sides of said permanent magnet.

29. The ignition coil apparatus as claimed in claim 26, wherein said synthetic resin molded part is disposed adjacent to at least four contiguous sides of said permanent magnet.

30. The ignition coil apparatus as claimed in claim 26, wherein said synthetic resin molded part is integral with said synthetic resin case.

31. The ignition coil apparatus as claimed in claim 26, wherein said primary coil is wrapped around a primary bobbin and said synthetic resin molded part is integral with said primary bobbin.

32. The ignition coil apparatus as claimed in claim 26, wherein said secondary coil is wrapped around a secondary bobbin and said synthetic resin molded part is integral with said secondary bobbin.

33. The ignition coil apparatus as claimed in claim 26, wherein said primary coil is wrapped around a cylindrical primary bobbin and said gap is located inside a cylindrical plane defined by an inner surface of said cylindrical primary bobbin.

34. The ignition coil apparatus as claimed in claim 26, wherein said secondary coil is wrapped around a cylindrical secondary bobbin and said gap is located outside a cylindrical plane defined by an outer surface of said cylindrical secondary bobbin.

* * * * *